US012509830B2

(12) United States Patent
Heald et al.

(10) Patent No.: US 12,509,830 B2
(45) Date of Patent: Dec. 30, 2025

(54) SECURITY BARRIER WITH COVERING AND METHOD OF INSTALLATION THEREOF

(71) Applicant: HEALD TECHNOLOGIES LTD, Hornsea (GB)

(72) Inventors: Jonathan Roderic Heald, Hornsea (GB); Debbie Heald, Hornsea (GB)

(73) Assignee: HEALD TECHNOLOGIES LTD, Hornsea (GB)

( * ) Notice: Subject to any disclaimer, the term of this patent is extended or adjusted under 35 U.S.C. 154(b) by 783 days.

(21) Appl. No.: 17/792,971

(22) PCT Filed: Jan. 14, 2021

(86) PCT No.: PCT/EP2021/050663
§ 371 (c)(1),
(2) Date: Jul. 14, 2022

(87) PCT Pub. No.: WO2021/144350
PCT Pub. Date: Jul. 22, 2021

(65) Prior Publication Data

US 2023/0046012 A1 Feb. 16, 2023

(30) Foreign Application Priority Data

Jan. 17, 2020 (GB) ..... 2000701

(51) Int. Cl.
*E01F 13/02* (2006.01)
*E01F 13/12* (2006.01)

(52) U.S. Cl.
CPC ..... *E01F 13/026* (2013.01); *E01F 13/12* (2013.01)

(58) Field of Classification Search
CPC ..... E01F 13/026; E01F 13/12; E04H 17/16
See application file for complete search history.

(56) References Cited

U.S. PATENT DOCUMENTS 7,607,856 B2 * 10/2009 Patel ..... E01F 15/003 404/6
7,699,558 B2 4/2010 Adler et al.
(Continued)

FOREIGN PATENT DOCUMENTS

EP 3441527 A1 2/2019
GB 2485278 A 5/2012
(Continued)

OTHER PUBLICATIONS

International Search Report and Written Opinion cited in corresponding PCT app No. PCT/EP2021/050663; Apr. 22, 2021; 13 pp.
(Continued)

*Primary Examiner* — Abigail A Risic
(74) *Attorney, Agent, or Firm* — Lempia Summerfield Katz LLC

(57) ABSTRACT

The invention relates to a security barrier (10, 40, 60, 82), and a method (100) of installation thereof, and in particular, although not exclusively, to the installation thereof to a bridge structure (70). The security barrier (10, 40, 60, 82) comprises a support (12, 62, 72) having at least one upright barrier member (14, 64, 85) thereon. The support (12, 62, 72) is for positioning substantially at ground level (41, 69, 72) and has a portion that is substantially planar with a leading edge (29). The at least one barrier member (14, 64, 85) is at the leading edge (29) or adjacent to the leading edge (29). The portion is for receiving a covering (75) thereon for adding mass to the security barrier (10, 40, 60, 82) and for biasing it towards the ground level (41, 69, 72). Two adjacent security barriers (10, 40, 60, 82) can be secured to each other with a joining member (200) to connect two adjacent barrier members (14) of the two adjacent security barriers (10, 40, 60, 82). The barrier member (10, 40, 60, 82) and the joining member (200) are for inhibiting the passage of a vehicle in the event of an impact force therefrom being
(Continued)

exerted on the at least one barrier member (14, 64, 85) and/or the joining member (200).

17 Claims, 10 Drawing Sheets

(56) References Cited

U.S. PATENT DOCUMENTS

| | | | | |
|---|---|---|---|---|
| 8,215,865 | B2 | 7/2012 | Adler et al. | |
| 8,215,866 | B2 * | 7/2012 | Whitford | F41H 5/14 404/9 |
| 8,277,143 | B2 | 10/2012 | Adler et al. | |
| 8,523,479 | B2 | 9/2013 | Adler et al. | |
| 9,127,421 | B2 | 9/2015 | Ball | |
| 9,127,422 | B2 | 9/2015 | Ball | |
| 9,133,590 | B2 * | 9/2015 | Ball | E01F 15/003 |
| 9,217,229 | B2 * | 12/2015 | Ball | E01F 13/12 |
| 11,613,858 | B2 * | 3/2023 | Ball | E01F 13/02 404/6 |
| 11,920,310 | B1 * | 3/2024 | Mills | E01F 9/685 |
| 2006/0090408 | A1 * | 5/2006 | Darcy | E01F 13/12 52/174 |
| 2007/0272911 | A1 * | 11/2007 | Fromm | E01F 13/12 256/65.14 |
| 2009/0028638 | A1 | 1/2009 | Crawford et al. | |
| 2009/0208285 | A1 | 8/2009 | Adler et al. | |
| 2010/0166498 | A1 | 7/2010 | Adler et al. | |
| 2010/0290833 | A1 | 11/2010 | Whitford | |
| 2011/0033232 | A1 | 2/2011 | Adler et al. | |
| 2012/0308302 | A1 | 12/2012 | Adler et al. | |
| 2013/0034387 | A1 | 2/2013 | Adler et al. | |
| 2014/0003867 | A1 * | 1/2014 | Ball | E01F 15/003 404/6 |
| 2014/0010591 | A1 * | 1/2014 | Ball | E01F 13/12 404/6 |
| 2014/0017003 | A1 | 1/2014 | Ball | |
| 2019/0257043 | A1 | 8/2019 | Azizinamini | |
| 2021/0189671 | A1 * | 6/2021 | Ball | E01F 13/12 |
| 2023/0349116 | A1 * | 11/2023 | Whitford | E01F 13/02 |

FOREIGN PATENT DOCUMENTS

| | | | |
|---|---|---|---|
| GB | 2487582 | A | 8/2012 |
| WO | 2007001326 | A2 | 1/2007 |
| WO | 2007040626 | A2 | 4/2007 |
| WO | 2007061541 | A2 | 5/2007 |
| WO | 2007091977 | A1 | 8/2007 |
| WO | 2010132616 | A1 | 11/2010 |
| WO | 2012101451 | A1 | 8/2012 |
| WO | 2020018661 | A2 | 1/2020 |

OTHER PUBLICATIONS

Search Report for corresponding foreign UK app No. GB 2000701.9; Date of Search: Jul. 7, 2020; 2 pp.

* cited by examiner

SECURITY BARRIER WITH COVERING AND METHOD OF INSTALLATION THEREOF

RELATED APPLICATION DATA

This application is a U.S. national stage of and claims priority benefit to prior filed international application no. PCT/EP2021/050663, filed Jan. 14, 2021, and which claims priority to British national application no. GB 2000701.9, filed Jan. 17, 2020. The entire contents of these prior filed applications are hereby incorporated by reference herein.

TECHNICAL FIELD

The invention relates to a security barrier, and a method of installation thereof, and in particular, although not exclusively, to the installation thereof to a bridge structure.

BACKGROUND

In recent years there has been an increase in terrorist and violent incidents on bridge structures whereby injury to pedestrians or cyclists on a pavement or road thereof has occurred. Typically such attacks have involved a vehicle driving along the road of the bridge and onto the pavement thereby causing injury. The pedestrians or cyclists are particular vulnerable on a bridge because there is nowhere for them to escape to in the event of an incident.

In such situations an option is to provide protection to the pedestrians in the form of a continuous railing between the pavement and the road of the bridge. The railing is required to be cemented or fastened in place on a deck of the bridge structure.

Such a railing has the disadvantage of not permitting cyclists to leave the road quickly if required. Furthermore, the continuous railing prevents pedestrians crossing the road, which is undesirable. Whereas the railing provides some protection to the pedestrians it does not provide full security barrier protection to stop the vehicle.

In addition, the railings are not easily fitted to an existing bridge structure. Such retrofitting of railings, or other security barrier, to a bridge structure typically requires that no foundation for the railings or security barrier is provided to avoid interfering with the bridge structure. Furthermore, such retrofitting of railings, or other security barrier must not interfere with a bridge expansion joints, which are typically required to accommodate heat expansion of the bridge, or movement of the bridge due to traffic or earth tremors. Use of a deep foundation for the railings or the security barrier may be a particular problem when installation is for certain applications, such as a bridge structure. In such an application it may not be permitted, or even possible, to use fasteners or cement to attach the security barrier to the deck of the bridge. For example, fasteners into the deck may interfere with a structure of the deck, which is undesirable. When retrofitting such a barrier to a bridge it may be desirable to avoid fastening it to the deck of the bridge.

These problems also exists in the inner city environment where walkways and pavements require protection. In such locations it may not be possible to excavate deep foundations. Furthermore, doorways and openings on the walkways or pavements may present a particular problem when providing security barrier protection because there is a gap to be protected (i.e. the doorway) where no fastening points are available.

Security barriers or bollards are typically provided in two categories. The first category is a high security barrier, or anti-terrorist barrier, that is intended to prevent a vehicle from passing. Such a barrier is robustly constructed and is typically about 1.0 to 1.5 metres above ground level, with a similar depth below ground for the foundation. A high security barrier might be used at a road entrance to an airport or an official building, such as a Government building, and is typically able to withstand a crash impact from a car or lorry travelling at 50 mph. The second category of security barrier might be used at a home or work premises to safeguard a car parking space or driveway from being used by an unauthorised vehicle. Such barriers are relatively less robustly constructed, and may extend up to 1.0 metre above ground level.

In general, there is no "middle ground" between the first and second categories of security barrier or bollard, for example to resist or impede a vehicle travelling at relatively lower speed, such as up to 30 mph, which may be encountered on a bridge structure. Whereas a barrier of the first category may be less robustly constructed to withstand such a vehicle, or a barrier of the second category may be more robustly constructed to withstand the vehicle, there remains an unfilled need for a barrier in the third "middle ground" category.

A fixed security barrier or bollard may be used for resisting the passage of a vehicle such as a car or a lorry. Such barriers typically comprise a support with a barrier member or post mounted to it. The support is typically cast into concrete foundations below ground level, or it may be surface mounted above the ground level for example using expandable bolts fixed into the ground. The barrier member is fixed in that it is not retractable, and in the working position the aim of the security barrier is to prevent or inhibit the passing of the vehicle.

It is also known to provide four security bollards or posts which are fixed in line on a support that is cast below the ground level. The support is typically elongate and of box-section construction having a depth of about 0.30 m below ground level. Such arrangements have the problem of requiring a deep foundation, i.e. 0.30 m below ground level, which may not be possible for a bridge structure. Using such a deep foundation is disadvantageous, particularly in an urban environment, because it may interfere with services such as power lines, drains, or communication cables.

There exists a need for a security barrier to protect cyclists and pedestrians from vehicles who may be, for example on a bridge, where the barrier has an ultra-shallow foundation, or surface mounting.

It is broadly an object of the present invention to address one or more of the above mentioned disadvantages of previously known security barriers.

SUMMARY

What is required is a security barrier apparatus that can be installed to a bridge structure, which may reduce or minimise at least some of the above-mentioned problems.

According to a first aspect of the invention, there is provided a security barrier, comprising a support having at least one upright barrier member thereon, the support for positioning substantially at ground level, the support having a portion that is substantially planar and having a leading edge, the at least one barrier member being at the leading edge or adjacent to the leading edge, the portion for receiving a covering thereon for adding mass to the security barrier and for biasing it towards the ground level, the barrier member for inhibiting the passage of a vehicle in the event of an impact force therefrom being exerted on the at least one barrier member.

Such a security barrier apparatus provides the advantage that no fasteners are required through the support to install the barrier member to the ground surface. Furthermore no cement is required to cast the support into the ground. It will be understood that the support (i.e. the portion) is substantially flat and horizontally orientated when the security barrier is placed on the ground, and that the support is biased to the ground under the action of gravity on the mass of the covering which is on the support. It will appreciated that the covering has an upper surface comprising a walkway or cycleway for a cyclist or pedestrian, and the covering may be slabs, pavers, bricks, etc, but it is also envisaged that the covering may be tarmac, cement, etc, which inhibits movement of the security barrier and thereby resisting the impact. Furthermore, since the support is substantially flat and horizontally orientated the security barrier has a very shallow, or ultra-shallow mounting to the ground. The security barrier has at least one barrier member that is fixed to the support which comprises an ultra-shallow plate that is biased to the ground by the covering. The security barrier may be mounted on (i.e. retrofitted to) a deck of a bridge structure without the requirement for a foundation in the deck of the bridge, which may be advantageous to avoid interfering with the bridge structure, or services such as power lines, drains, or communication cables. The upper surface is an uppermost part of the security barrier on which a cyclist can ride or a person can walk. Such a security barrier may be configured to substantially prevent a vehicle from passing in order to safeguard the pedestrians or cyclists, and may provide a security barrier in the third "middle ground" category mentioned above.

In one embodiment the at least one barrier member comprises at least one post. In another embodiment the at least one barrier member comprises at least one panel. It will be appreciated that the barrier member is fixed to the support so that it is secured thereto and does not move relative thereto.

Preferably the portion has a trailing edge comprising one or more teeth, each tooth extending in substantially a horizontal direction. The teeth extend away from the trailing edge in the plane of the portion and provide the advantage of digging into the ground in the event of an impact on the barrier member, which inhibits the barrier member from moving.

Preferably the security barrier includes a plurality of teeth, wherein at least one of the teeth has a different horizontal dimension to another of the teeth. Such an arrangement provides the advantage that the teeth may be more likely to dig into ground in the event of an impact and thereby resist movement of the security barrier.

Preferably a ratio of a horizontal dimension of the one or more teeth relative to the support is between 0.2 and 0.7, and preferably 0.36. Preferably a dimension between free ends of adjacent teeth is between 0.2 and 0.7 m. Preferably the teeth comprise a saw-tooth pattern. Such arrangements may provide the advantage that the teeth may be more likely to dig into ground in the event of an impact.

Preferably the barrier member has a flange at a lower end thereof, the barrier member being arranged to pass through the support, and the flange being secured to the support.

The barrier member may pass through an aperture of the support from below the support for construction of the security barrier. Preferably the support has a recess underneath it and the flange is within the recess. Such arrangements provide the advantage of an improved connection of the barrier member to the support and an improved strength to the security barrier apparatus.

Preferably the support comprises a lower plate and an upper plate, which are spaced apart and secured to each other. Securing of the plates may be with fasteners or by welding. Preferably the one or more teeth are on the lower plate. Such a construction of the support provides the advantage of additional strength to the security barrier, and an improved operation thereof.

Preferably the security barrier further includes one or more rings around a base of the barrier member and on top of the support, the one or more rings being secured to the support. Preferably the flange is secured to the one or more rings by one or more fasteners. Such an arrangement assists with attaching the barrier member to the support with a secure connection, and may also assist with providing a barrier member that is readily removable and replaceable should it be damaged.

Preferably the at least one post comprises a tube. The tube may have a diameter of between 0.14 m to 0.3 m, and preferably 0.22 m. The tube may have an inner post. Preferably the inner post is close fitting within the tube. The tube and/or the inner post may be for example of steel. Such an arrangement provides an inner post and outer post, and has the advantage that the barrier member has an improved strength.

Preferably the support has one or more attachment locations along a lateral edge thereof. Such attachment location are for joining adjacent barriers together for example using one or more fasteners, a tongue/groove arrangement, or by welding. In a preferred embodiment the one or more attachment locations comprise fastener locations for receiving one or more fasteners. Preferably the fastener locations comprise through holes.

Preferably the security barrier further includes a connector part for cooperation with the one or more attachment points. Such a connector part may be a plate for joining adjacent barriers together.

Preferably the security barrier includes the covering.

Preferably the at least one barrier member has a vertical dimension above the support of between 0.8 m to 1.2 m, and preferably 1 m. Preferably the support has a length of between 1.0 m to 1.8 m, and preferable 1.4 m. Preferably the support has a width of between 1.0 m and 1.4 m, and preferably 1.2 m. Preferably the support has a depth in the vertical dimension of between 0.01 m and 0.24 m, and preferably 0.12 m. Such dimensions provide an advantages configuration or arrangement for the security barrier.

Preferably the support is of steel plate. Preferably the support is rectangular in plan view. It will be understood that the plan view is from above during normal orientation of the security barrier in use.

Preferably the at least one post or panel is at the leading edge of the security barrier. Preferably the support has a trailing edge with an attachment part. Preferably the attachment part comprises an attachment panel. Such an attachment part provides the advantage that it may be used to attach the security barrier to a structure, for example by clamping or fastening. The attachment part may be used for abutment thereof to the structure.

Preferably the attachment part is upright, and has a vertical dimension above the support of between 0.1 m to 0.7 m, and preferably 0.5 m.

Preferably the attachment part has one or more attachment points. Preferably the one or more attachment points comprise fastener locations for receiving one or more fasteners. Preferably the fastener locations comprise through holes.

According to a second aspect of the invention there is provided a plurality of security barriers according to the first aspect of the invention, wherein the security barriers are secured to each other along the lateral edge thereof such that the barrier members of the plurality of security barriers are in line with each other. The line of barrier members may be a straight line or a staggered line. Such an arrangement provides the advantage of a walkway or a cycleway on one side of the barrier members so that pedestrians or cyclists can be separated from vehicles driving on the other side of the barrier members.

Preferably the one or more connector parts are provided between adjacent security barriers. Preferably the one or more connector parts are provided between the lower plates and the upper plates of adjacent security barriers.

According to a third aspect of the invention there is provided a plurality of security barriers according to the first aspect of the invention, wherein the security barriers are spaced apart from one another so that there is a gap between adjacent posts or panels at the leading edges thereof, and so that the barrier members of the plurality of security barriers are in line with each other. The line of barrier members may be a straight line or a staggered line. Such an arrangement provides the advantage of a walkway or a cycleway on one side of the barrier members so that pedestrians or cyclists can be separated from vehicles driving on the other side of the barrier members. Furthermore, such an arrangement with gaps between adjacent posts or panels of the security barriers permit cyclists or pedestrians to readily enter or exit the cycleway or walkway if required, for example to escape a vehicle, or to allow pedestrians to cross the road.

Preferably a lateral dimension of the supports of a first set of security barriers are longer than a lateral dimension of the supports of a second set of security barriers, the plurality of security barriers being next to one another so that the barrier members of the first set are in line with each other, and the barrier members of the second set are in line with each other. Such an arrangement may be used to provide a walkway and a cycleway next to each other.

Preferably the security barriers of the first set are alternately located relative to the security barriers of the second set, wherein a first gap is provided between adjacent pots or panels at the leading edges of the security barriers of the first set, and a second gap is provided between adjacent posts or panels at the leading edges of the security barriers of the second set. Such gaps between adjacent posts or panels permit cyclists or pedestrians to readily enter or exit the cycleway or walkway if required.

In one embodiment a plurality of security barriers are provided, wherein two adjacent security barriers are joined to each other with a joining member to connect two adjacent barrier members of the two adjacent security barriers, the joining member for inhibiting the passage of a vehicle in the event of an impact force therefrom.

Preferably the joining member has a connection device at each end thereof for securing each end of the joining member to the two adjacent barrier members. Preferably at least one connection device comprises an expansion joint for permitting the joining member to move relative to the barrier member associated with the expansion joint.

In a preferred embodiment at least one of the connection devices comprises a tube, wherein one of the two adjacent barrier members is located in the tube. Preferably both of the connection devices each comprise a tube, wherein the other of the two adjacent barrier members is located in the tube. Preferably one of the tubes has an elongate cross-section and comprises the expansion joint.

Preferably each tube is secured to its respective barrier member with a capping plate which is fixed to a respective barrier member to sandwich each tube between each capping plate and the support of each security barrier. Preferably each tube rests on a plate at a base of the barrier member associated with each tube. Preferably one of the plates is a slide plate.

In a preferred embodiment the joining member comprises at least one beam. Preferably the at least one beam has a square cross-section. Preferably the at least one beam is connected to the two adjacent barrier members so that the opposing edges of the square cross-section are arranged horizontally and vertically respectively.

According to a fourth aspect of the invention there is provided a bridge structure including the plurality of security barriers according to the second or third aspects of the invention, wherein the support of each security barrier rests on a deck of the bridge, and the attachment part of each security barrier is secured to a wall of the bridge structure. According to another aspect of the invention there is provided a bridge structure including the plurality of security barriers according to the second or third aspects of the invention, wherein the support of each security barrier rests on a deck of the bridge.

According to a fifth aspect of the invention there is provided a method of installing one or more security barriers for inhibiting the passage of a vehicle, each security barrier comprising a support having at least one upright barrier member thereon, each support having a portion that is substantially planar and having a leading edge, each barrier member being at the leading edge or adjacent to the leading edge of each support, the method including:

placing each support at ground level; and installing a covering onto the portion of each security barrier for adding mass thereto and to bias each security barrier towards the ground level.

Such a method provides the advantage that no fasteners are required through the support to install the barrier member to the ground surface. Furthermore no cement is required to cast the support into the ground. It will be understood that the support (i.e. the portion) is substantially flat and horizontally orientated when the security barrier is placed on the ground, and that the support is biased to the ground under the action of gravity on the mass of the covering which is on the support. It will appreciated that the covering has an upper surface for a walkway or cycleway for a cyclist or pedestrian, and the covering may be slabs, pavers, bricks, etc, but it is also envisaged that the covering may be tarmac, cement, etc, which inhibits movement of the security barrier and resisting the impact. Furthermore, since the support is substantially flat and horizontally orientated the security barrier has a very shallow, or ultra-shallow mounting to the ground. The security barrier has at least one barrier member that is fixed to the support which comprises an ultra-shallow plate that is biased to the ground by the covering. The security barrier may be mounted on (i.e. retrofitted to) a deck of a bridge structure without the requirement for a foundation in the deck of the bridge, which may be advantageous to avoid interfering with the bridge structure, or services such as power lines, drains, or communication cables. The upper surface is an uppermost part of the security barrier on which a cyclist can ride or a person can walk. Such a security barrier may be configured to substantially prevent a vehicle from passing in order to safeguard the pedestrians or cyclists, and may provide a security barrier in the third "middle ground" category mentioned above.

In one embodiment the method further includes:

placing a plurality of security barriers at ground level wherein adjacent security barriers are next to each other; and securing adjacent security barriers to each other along a lateral edge thereof such that the barrier members of the plurality of security barriers are in line with each other.

The line of barrier members may be a straight line or a staggered line. Such an arrangement provides the advantage of a walkway or a cycleway on one side of the barrier members so that pedestrians or cyclists can be separated from vehicles driving on the other side of the barrier members.

Preferably the method further includes using one or more connector parts to secure adjacent security barriers. Preferably the method further includes using one or more fasteners to secure adjacent security barriers using the one or more connector parts.

In another embodiment the method further includes:

placing a plurality of security barriers at ground level wherein the security barriers are spaced apart from one another so that there is a gap between adjacent barrier members at the leading edges thereof, and so that the barrier members of the plurality of security barriers are in line with each other.

The line of barrier members may be a straight line or a staggered line. Such an arrangement provides the advantage of a walkway or a cycleway on one side of the barrier members so that pedestrians or cyclists can be separated from vehicles driving on the other side of the barrier members. Furthermore, such an arrangement with gaps between adjacent posts or panels of the security barriers permit cyclists or pedestrians to readily enter or exit the cycleway or walkway if required, for example to escape a vehicle, or to allow pedestrians to cross the road.

Preferably the method further includes:

to providing first and second sets of security barriers wherein a lateral dimension of the supports of the first set are longer than the supports of a lateral dimension of the second set; and placing the plurality of security barriers at ground level wherein the supports of the plurality of security barriers are next to one another so that the barrier members of the first set are in line with each other, and the barrier members of the second set are in line with each other.

Such an arrangement may be used to provide a walkway and a cycleway next to each other.

Preferably the method further includes alternately locating the security barriers of the first set relative to the security barriers of the second set, such that a first gap is provided between adjacent barrier members at the leading edges of the security barriers of the first set, and a second gap is provided between adjacent barrier members at the leading edges of the security barriers of the second set.

Such gaps between adjacent panels permit cyclists or pedestrians to readily enter or exit the cycleway or walkway if required.

In another embodiment each support has a trailing edge with an attachment part, the method further including:

placing the plurality of security barriers at ground level on a deck of a bridge structure so that the support of each security barrier rests on the deck; and using the attachment part to secure each security barrier to a wall of the bridge structure.

Such a method provides the advantage that the attachment part is used to attach the security barrier to a structure, for example by clamping or fastening. The attachment part may be use for abutment thereof to the structure. It will be appreciated that in this embodiment the ground level is the bridge deck.

In one embodiment the method further includes:

placing a plurality of security barriers at ground level; and securing two adjacent security barriers to each other with a joining member to connect two adjacent barrier members of the two adjacent security barriers, the joining member for inhibiting the passage of a vehicle in the event of an impact force therefrom.

Preferably the joining member has an expansion joint on at least one end thereof, the method further including;

securing the two adjacent security barrier members using the expansion joint for permitting the joining member to move relative to the barrier member associated with the expansion joint.

Preferably the joining member comprises at least one tube at an end thereof, the method further including:

using the at least one tube to secure the two adjacent security barriers to each other by locating one of the two adjacent barrier members in the tube.

In one embodiment the method further includes:

placing the plurality of security barriers at ground level on a deck of a bridge structure so that the support of each security barrier rests on the deck, and so that the two security barriers are at either side of a bridge expansion joint; and securing the two adjacent security barriers to each other using the joining member so that it is above the bridge expansion joint.

According to an alternative characterisation of the invention there is provided a security barrier comprising a support having at least one upright barrier member thereon, the support for positioning substantially at ground level, the support being substantially planar and having a leading edge and a trailing edge, the at least one barrier member being at the leading edge or adjacent to the leading edge, the trailing edge having one or more teeth extending in substantially a horizontal direction, the support for receiving a covering thereon for adding mass to the security barrier and for biasing it towards the ground level, wherein the one or more teeth are arranged to dig into the ground in the event of an impact force from a vehicle being exerted on the at least one barrier member for inhibiting the passage of the vehicle.

According to an alternative characterisation of the invention there is provided a security barrier comprising a support having at least one upright barrier member thereon, the support for positioning substantially at ground level, the support being substantially planar and having a leading edge and a trailing edge, the at least one barrier member being at the leading edge, the trailing edge having an attachment part for securing the security barrier to a structure, the support for receiving a covering thereon for adding mass to the security barrier and for biasing it towards the ground level, wherein the attachment part is arranged for transferring an impact force to the structure in the event of a vehicle hitting the at least one barrier member thereby inhibiting the passage of the vehicle.

According to an alternative characterisation of the invention there is provided at least two security barriers, each security barrier comprising a respective support having at least one upright barrier member thereon, each support for positioning substantially at ground level, each support having a portion that is substantially planar and having a leading edge, the at least one barrier members being at the leading edge or adjacent to the leading edge of each support, each portion for receiving a covering thereon for adding mass to the security barriers and for biasing them towards the ground level, the two security barriers being joined to each other with a joining member to connect the barrier members of the each security barriers, the barrier members and the joining member for inhibiting the passage of a vehicle in the event of an impact force therefrom being exerted on the at least one barrier member or the joining member.

Any preferred or optional features of one aspect or characterisation of the invention may be preferred or optional feature of other aspects or characterisations of the invention.

BRIEF DESCRIPTION OF THE DRAWINGS

Other features of the invention will be apparent from the following description of preferred embodiments shown by way of example only with reference to the accompanying drawings, in which.

DETAILED DESCRIPTION

Figure 1:
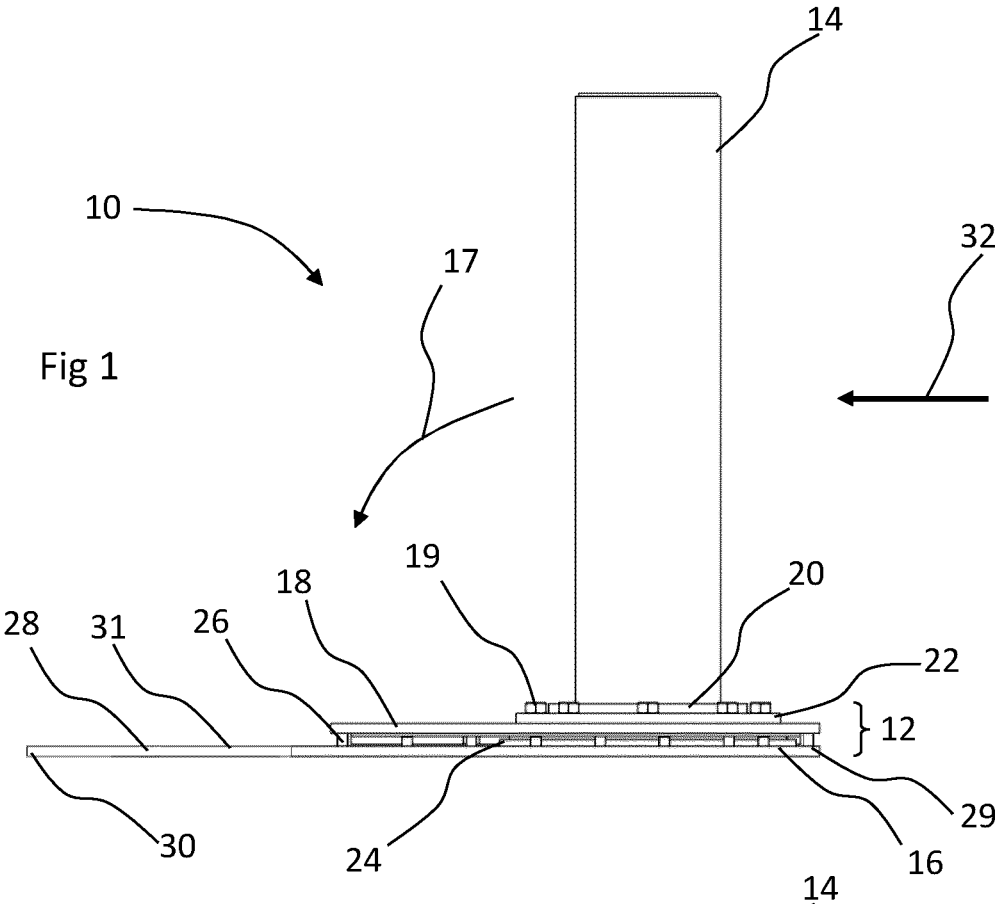
FIG. 1 shows a side view of a security barrier apparatus according to an embodiment of the invention.

FIG. 1 shows a side view of a security barrier apparatus according to an embodiment of the invention, generally designated 10. The apparatus 10 comprises a base 12, also known as a support, with one upright post 14 thereon. The post 14 is, for example, a steel tube which is about 1 m above the ground and about 0.22 m in diameter, and may be alternatively termed a bollard or a barrier member. The post 14 is fixed to the base 12 so that it does not move relative thereto. The base 12 is about 0.12 m in height above the ground.

The base 12 comprises a lower plate 16 and an upper plate 18 with two rings 20, 22 above the upper plate 18. The two rings 20, 22 are around a circumference of the post 14 at a base thereof. The two rings 20, 22 are secured to the lower and upper plates 16, 18 with bolts 19. The post 14 has a flange 24 around a base thereof which is welded to the post 14. The lower plate 16 and the upper plate 18 are spaced apart from each other by one or more horizontal spacer plates. The lower plate 16 and the upper plate 18 are arranged one on top of one another, and the flange 24 may be sandwiched therebetween. The bolts 19 operate to tighten the two rings 20, 22 to the lower flange 24 so that the post 14 is secured to the base 12.

A plurality of spacers 26 are provided between the lower and upper plates 16, 18 to provide a rigid connection therebetween. The spacers 26 may be alternatively termed ribs. The spacers 26 are of steel and are welded to each of the lower and upper plates 16, 18. Alternatively the spacers 26 may be fasteners. The lower plate 16, the upper plate 18, the rings 20, 22, and the flange 24 provide a secure attachment of the post 14 to the base 12. The base 12 comprises a shallow box construction which is about 1.4 m in length and about 1.2 m in width. Such a shallow box may be termed a flat box, and is very strong and rigid. The box construction of the base 12 also provides the advantage of having less steel than would otherwise be the case if the base were of solid steel. It will be appreciated that the lower plate 16 rests on the ground, i.e. at ground level.

Also shown in FIG. 1 is an extension part 28 of the lower plate 16 along one edge thereof. The extension part 28 is a part of the lower plate 16 and has one or more teeth 30, which are shown more clearly in FIG. 3. The extension part 28 is on a trailing edge 31 of the lower plate 16. Accordingly the teeth 33 are in the plane of the base 12 (i.e. the lower plate 16) and are substantially horizontal. In the event of an impact by a vehicle indicated by arrow 32 on a leading edge 29 thereof, the impact load is transferred to the lower plate 16 and the one or more teeth 30 dig into the ground to transfer the impact load into the ground. The impact load 32 on the post 14 effects a rolling motion (i.e. a rotational movement 17) onto the security barrier 10 so that the teeth 30 dig into the ground. It will be appreciated that the teeth 30 are pointed so that a high pressure is generated in the event of the impact load 32.

Figure 2:
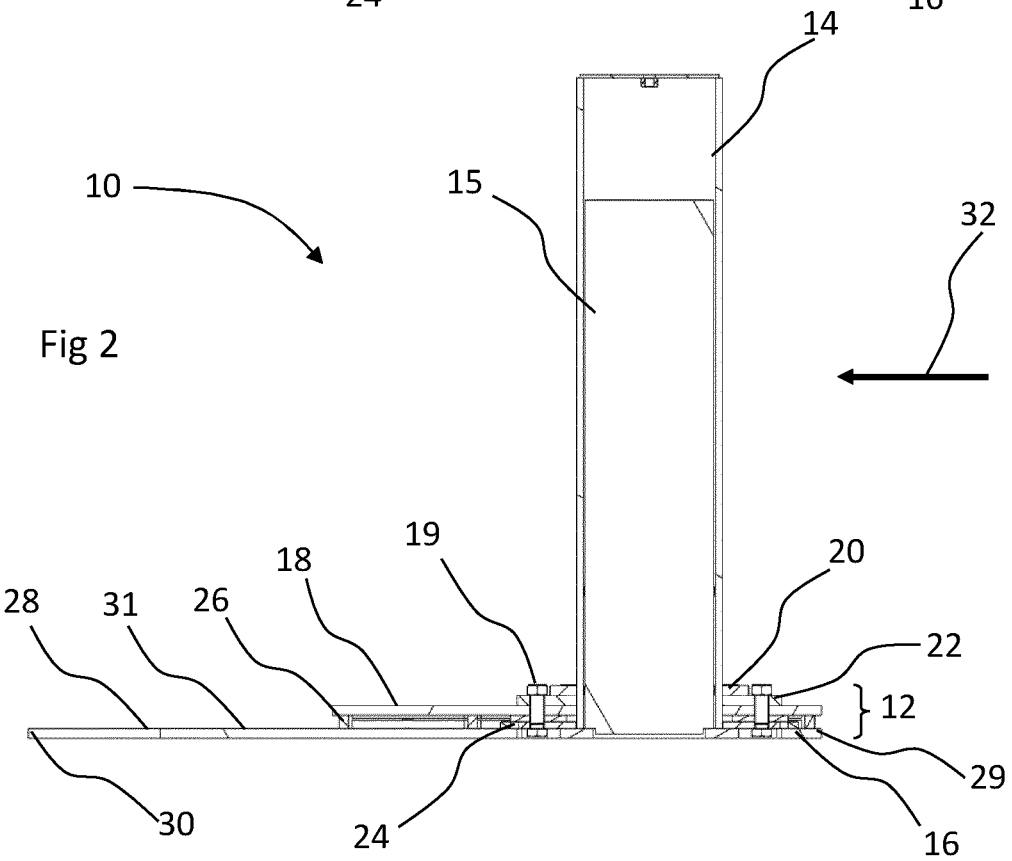
FIG. 2 shows a cross section of the security barrier apparatus shown in FIG. 1.

FIG. 2 shows a cross section of the security barrier apparatus shown in FIG. 1. In FIG. 2 like features to the arrangements of FIG. 1 are shown with like reference numerals. In FIG. 2 an inner post 15 is shown within the post 14, which may be termed an outer post. The inner post 15 is, for example, a steel tube which is about 0.8 m above the ground and about 0.2 m in diameter, and may be alternatively termed a bollard or a barrier member. The inner post 15 is close fitting within the post 14 and provides additional strength to the security barrier apparatus 10. The inner post 15 is fixed within the post 14 and is secured to the base 12 so that it does not move relative thereto. The inner post 15 may be of solid concrete.

The base 12 is constructed by welding the lower and upper plate 16, 18 together using the spacers 26. The spacers 26 are substantially vertical and operate to strengthen the base 12 and to resist deforming thereof if a vehicle should drive on the upper plate 18. The posts 14, 15 are inserted from underneath the base 12, and the bolts 19 are also inserted through respective holes in the flange 24 from underneath the base 12. The flange 24 fits into a recess of the lower plate 16 of the base 12. The two rings 20, 22 are welded together and are loose around the post 14 so that they rest on the upper plate 18. The two rings 20, 22 are clamped onto the base 12 by the bolts 19 when they are tightened, which also urges the flange 24 of the post 14 into the recess in the lower plate 16.

A plurality of additional steel plates are also shown in FIG. 2 between the lower and upper plates 16, 18 and around a lower end of the post 14. The additional steel plates are spacer plates which permit the flange 24 of the post 14 to be bolted between the lower and upper plates 16, 18. The additional plates also provide additional mass and support around the lower end of the post 14 to provide additional strength to the connection between the posts 14, 15, and the base 12. The additional plates also assist with transferring an impact load from a vehicle indicated by arrow 32 to the ground.

The security barrier apparatus 10 is constructed from steel, for example, the posts 14, 15 are steel tubes with a wall thickness of about 1 cm, and the lower and upper plates 16, 18, the rings 20, 22, spacers 26, and additional steel plates are of steel plate which is about 15 mm thick.

Figure 3:
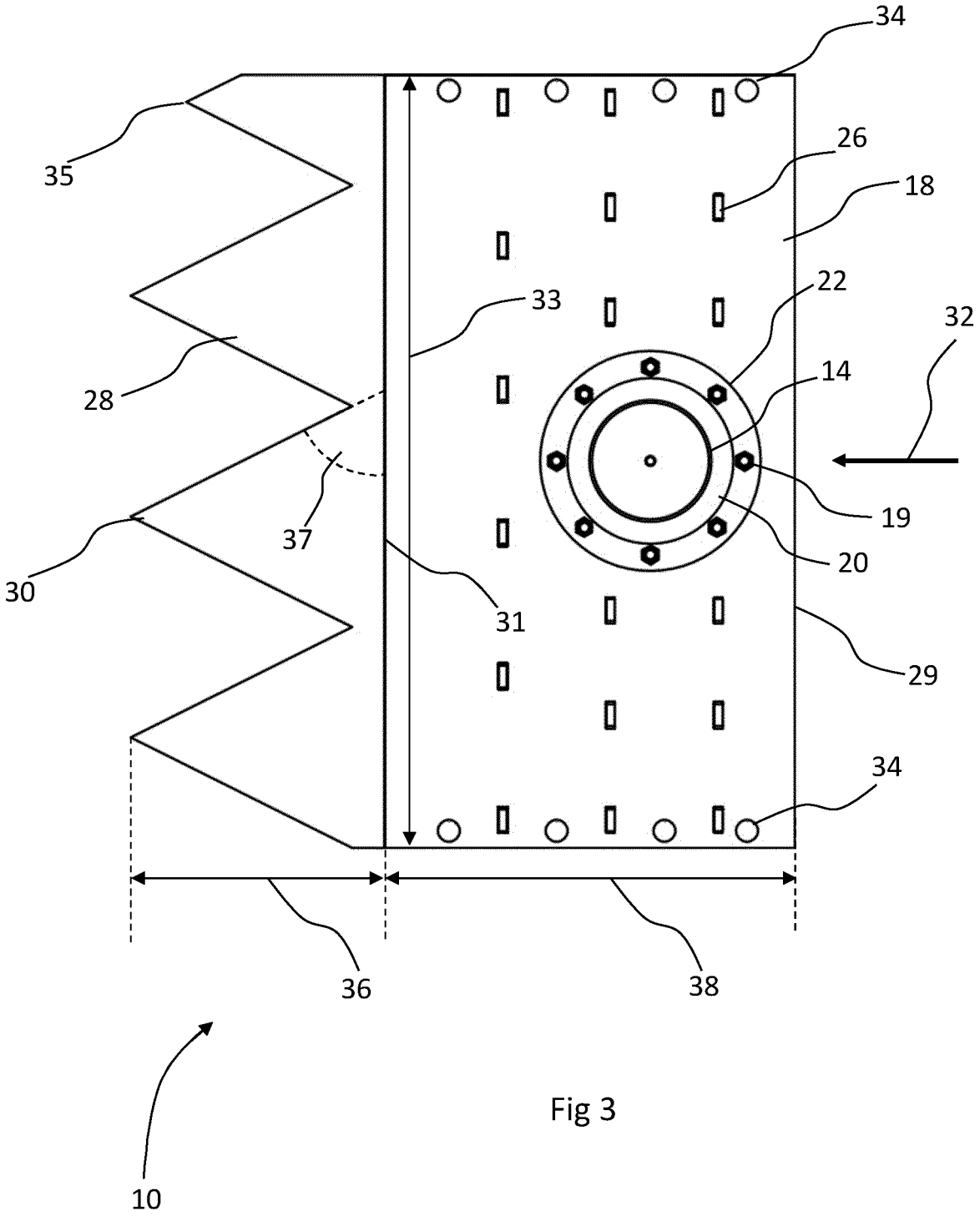
FIG. 3 shows a plan view of the security barrier apparatus shown in FIGS. 1 and 2.

FIG. 3 shows a plan view of the security barrier apparatus shown in FIGS. 1 and 2. In FIG. 3 like features to the arrangements of FIGS. 1 and 2 are shown with like reference numerals. In FIG. 3 eighteen spacers 26 are shown, which are welded into respective holes in the lower and upper plates 16, 18 to secure them together. Each spacer 26 is a small rectangular plate and is welded in position so that a plane of each spacer 26 is normal to the leading edge 29 of the security barrier apparatus 10. The spacers 26 are substantially vertical and operate to strengthen the base 12 to resist deforming thereof if a vehicle impacts the post indicate by arrow 32.

The upper plate 18 is shown to be rectangular. The teeth 30 are also shown along the trailing edge 31 of the security barrier apparatus 10. In the embodiment of FIG. 3 there are four teeth 30, which form a saw-tooth arrangement on the trailing edge 31, although it will be appreciated that there may be more or less teeth 30, for example one tooth 30 or up to ten teeth. In the embodiment shown each edge of the teeth 30 form an angle 37 of about 60° with the trailing edge 31, but an angle 37 of between 40 to 70° is also envisaged when there are more or less teeth 30. One of the teeth 35 may be shorter than the other teeth 30 to provide a different dimension of the tooth 35 from the trailing edge 31. In the example shown the direction of the impact 32 is illustrated along a perpendicular to the leading edge 29, but it will be appreciated that a vehicle may impact the post 14 at any angle between the perpendicular and 90° to the perpendicular.

The teeth 30, 35 are shown in a saw-tooth arrangement, but it will be appreciated that that the teeth 30, 35 may comprise fingers or arms, or any part or portion of the base 12 that extends in a horizontal direction away from the trailing edge 31. All such parts, portions, fingers, or arms of the base 12 may be termed teeth. In a preferred arrangement the part or portion of the base 12 has a free end that is pointed, or substantially pointed, so that is can dig into the ground in the event of an impact 32.

It can been seen that the security barrier apparatus 10 has a relatively large footprint, which assists with the transfer of the impact load at 32 to the ground. For example, the dimension of a transverse dimension 38 of the upper plate 18 may be 0.76 m, and a dimension of a transverse dimension 36 of the extension part 28 of the lower plate 16 may be 0.44 m. The dimension of a lateral dimension 33 of the upper plate 18 may be for example 1.4 m. In the event of an impact at 32 the teeth 30, 35 of the extension part 28 dig into the ground which assists with transferring the impact load 32 to the ground. The ratio of the dimensions 36 to 38 may be 0.6, but it is envisaged that the ratio may be between 0.2 and 1.0 in certain embodiments. The ratio of the combined dimensions 36 and 38 compared to the height of the post 14 above the base 12 may be 1.0, but it is envisaged that the ratio may be between 0.8 and 1.2 in certain embodiments.

FIG. 3 also shows four bolt holes 34 along each transverse edge (i.e. lateral edge) of the security barrier apparatus 10. The bolt holes 34 pass though the lower and upper plates 16, 18, and may be used to secure multiple security barrier apparatuses 10 in a line as shown in FIGS. 4 and 5.

Figure 4:
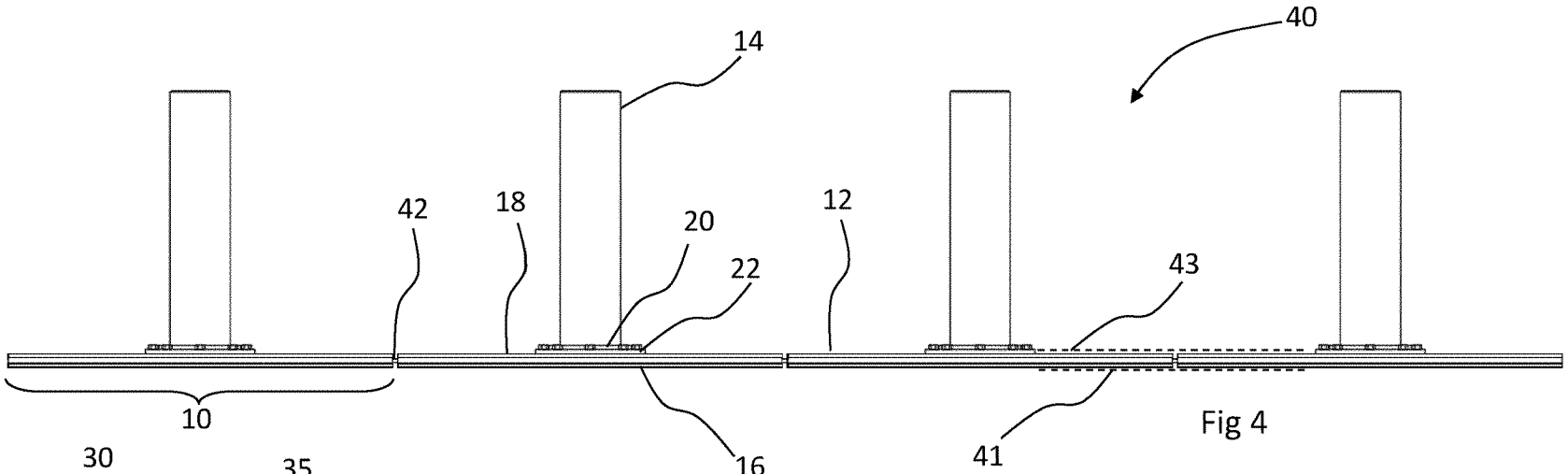
FIG. 4 is a front view of four of the security barriers of FIGS. 1 to 3 connected in a line.

FIG. 4 is a front view of four of the security barriers 10 of FIGS. 1 to 3 connected in a line to form a security barrier apparatus 40. In FIG. 4 like features to the arrangements of FIGS. 1, 2 and 3 are shown with like reference numerals. In FIG. 4 the four security barriers 10 are secured together by three connector plates 42 between adjacent security barriers 10 so that there four posts 14 which are spaced apart on the combined base 12. Each connector plate 42 is sandwiched between the lower and upper plates 16, 18 of one security barrier apparatus 10, and sandwiched between the lower and upper plates 16, 18 of an adjacent security barrier apparatus 10. When the four security barriers 10 are connected together the four posts 14 are aligned with each other to form a straight line of posts 14 in the assembled position of the security barrier apparatus 40. It will be appreciated that many more than four security barriers 10 may be connected together as required, for example ten or more.

In FIG. 4 the security barrier apparatus 40 is shown to be located on a ground surface 41. Another surface (i.e. covering, slabs, pavers, bricks, tarmac, cement, or other surface such as a driving surface for a vehicle or cyclist, or a walking surface for pedestrians, or other anti-slip coating) is then installed on top of the upper plate 18 of the base 12 as indicated at 43, which provides a mass on top of the security barrier apparatus 40. As such the posts 14 are above ground level. The mass on top of the security barrier apparatus 40 anchors the security barrier apparatus 40 to the ground 41. It will be appreciated that the base 12 is about 4 cm in height above the ground surface 41, which is very shallow.

Figure 5:
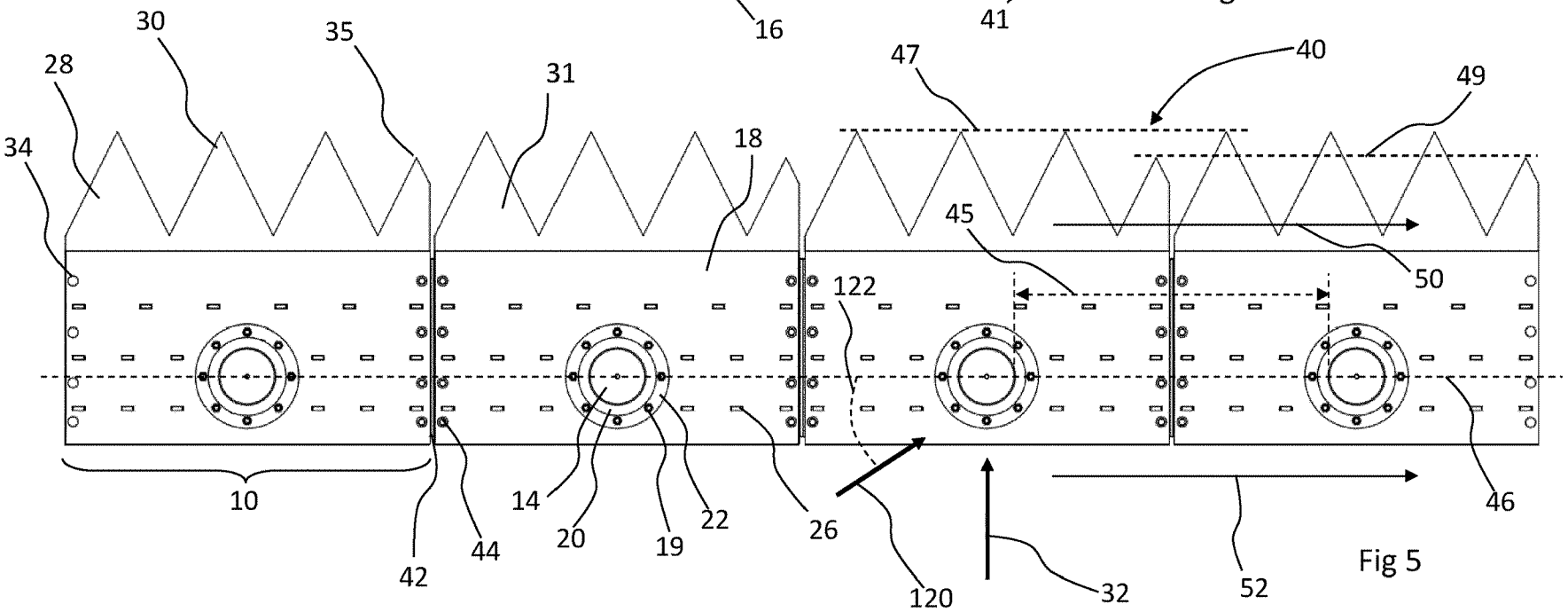
FIG. 5 is a plan view of the arrangement of FIG. 4.

FIG. 5 is a plan view of the arrangement of FIG. 4. In FIG. 5 like features to the arrangements of FIGS. 1 to 4 are shown with like reference numerals. In FIG. 5 each connector plate 42 is shown to be secured to two adjacent security barriers 10 by eight fasteners 44 (e.g. bolts) which pass through the bolt holes 34 such that there are four fasteners 44 in each security barrier 10. Each connector plate 42 is a length of sheet steel, and each of the fasteners 44 are recessed so that a head and tail thereof is flush with an upper surface of the upper plate 18, and a lower surface of the lower plate 16. The four posts 14 of the four security barriers 10 define a substantially vertical plane, which is represented by a dashed line 46. It will be appreciated that the four posts 14 are substantially upright so that they are substantially parallel to one another. Typically the security barrier apparatus 40 has dimensions so that a vehicle (not shown) cannot fit between the posts 14. In one arrangement the posts 14 are spaced apart from one another, for example by a distance of about 1.2 m as shown by an arrow 45. In other words, the maximum gap 45 between adjacent posts is set so that it is not more than 1.2 m.

It will be appreciated that with the security barrier apparatus 10, 40 there is no need to use bolts or other fasteners to secure it to the ground 41 in view of the mass (i.e. covering, slabs, pavers, bricks, tarmac, cement, etc) on top thereof. In such a manner the base 12 is provided with at least one ground anchor due to the mass of the slabs and the security barrier apparatus 10, 40 itself. However, if required additional fasteners (e.g. expandable bolts) may be used to secure the security barrier apparatus 10, 40 to the ground 41. For example, each base 12 may have holes spaced along the length thereof to receive fasteners if required to provide additional anchors of the apparatus 10, 40 to the ground 41.

Also shown in FIG. 5 are the teeth 30, 35, which are staggered in plan view. For example, the ends of the teeth 30 of one barrier 10 form a line 47 with the ends of the teeth 30 of one or more other barriers 10. Furthermore, the ends of the tooth 35 of one barrier 10 forms a line 49 with the ends of the tooth 35 of one or more other barriers 10. The lines 47, 49 are staggered (i.e. spaced apart) such that the line 47 is furthest from the post 14, and the line 49 is closest to the post 14. The spacing between the lines 47, 49 may be about 10 cm.

The Applicant has found that the teeth 30 provide a significant advantage when transferring the impact load 32 into the ground. For example, if the trailing edge 31 did not have teeth 30, 35, and if the trailing edge 31 was only a flat edge, the impact load 32 would not be transferred to the ground as readily because the flat edge would not dig into the ground as much. In other words, without the teeth 30, 35 the barrier security barrier apparatus 10, 40 would be more prone to slide on the ground 41 than be stopped by the ground 41.

Also shown in FIG. 5 is an arrow 120 which represents an impact by a vehicle on the post 14. The arrow 120 is at an angle 122 of about 30° to the dashed line 46 and represents a typical angle at which the impact may be received on the post 14.

From the foregoing it can be seen that the post 14 is adjacent to the leading edge 29 of the security barrier apparatus 10, 40. In other words the one or more posts 14 are towards the leading edge 29, for example a front edge of the security barrier apparatus 10, 40 is about 14 cm from the front of the one or more posts 14. Such a positioning of the post 14 on the base 12 provides the advantage that if a vehicle impacts the one or more posts 14, as shown by arrow 32, the trailing edge 31 is relatively further away from the post 14, which provides a mechanical advantage when transferring the impact load to the ground.

It will be understood from the foregoing that the pedestrians or cyclists are intended to walk or cycle on one side of the posts 14, as indicate by an arrow 50, and that vehicles are intended to drive on the other side of the posts 52.

In one arrangement the security barrier apparatus 10 has one post 14 thereon, and in another arrangement several security barrier apparatuses 10 may be connected together using one or more connector plates 42 to form a multi-post 14 barrier 40. It is also envisaged that there may be more than one posts 14 on the security barrier apparatus 10, for example, two posts 14.

It will be understood that each connector plate 42 has through holes therein to receive the fasteners 44 to join adjacent security barriers 10. In one arrangement each connector plate 42 has elongate through holes to allow for expansion or contraction of the bridge 70 on hot or cold days. In effect each joint between adjacent security barriers 10 is an expansion joint, and it is envisaged that other means may be provided to allow such expansion.

Figure 6:
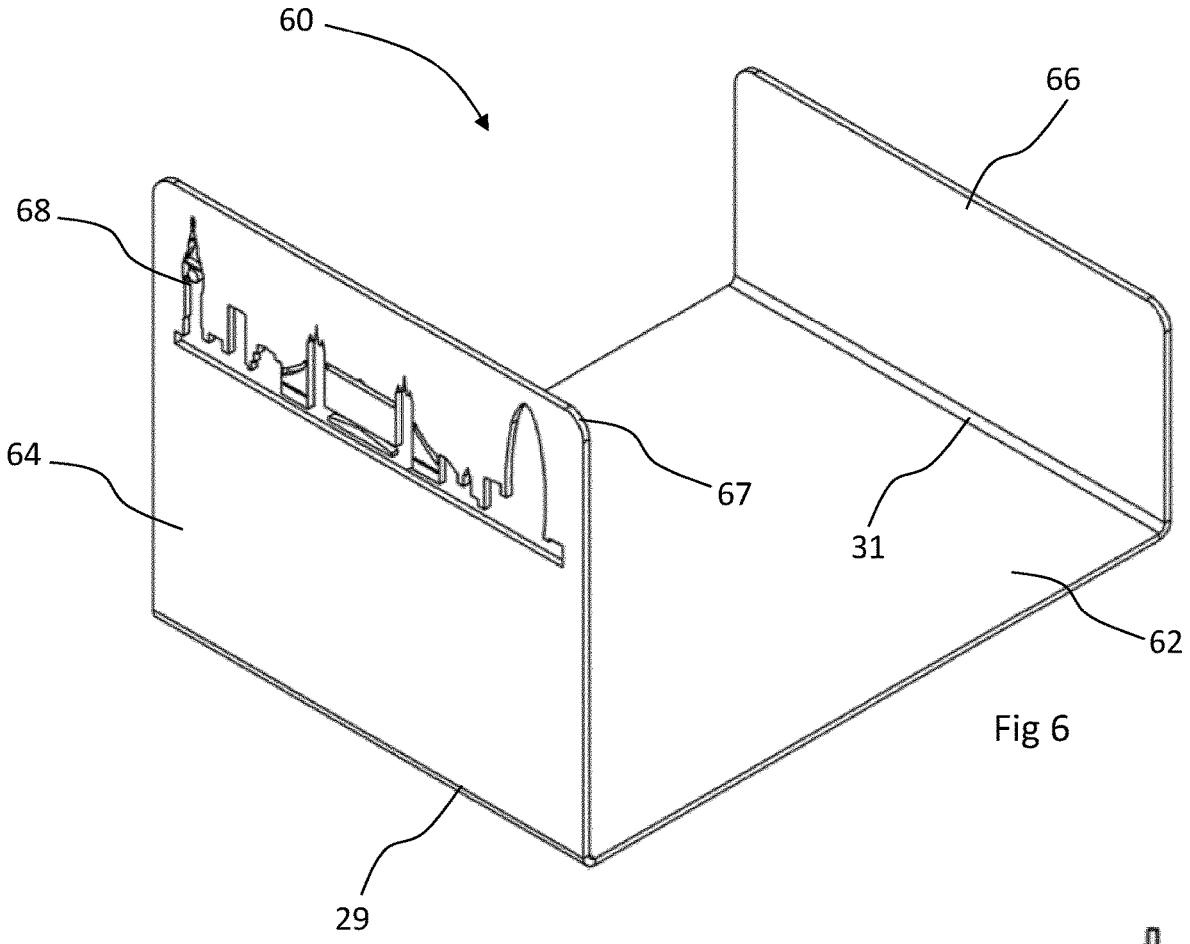
FIG. 6 is a perspective view a security barrier apparatus according to another embodiment of the invention.

FIG. 6 is a perspective view a security barrier apparatus according to another embodiment of the invention, generally designated 60. The security barrier apparatus 60 has a base plate 62 with a front plate 64 at one edge thereof, and a rear plate 66 at an opposing edge (i.e. trailing edge 31) thereof. The front plate 64 is at the leading edge 29 of the security barrier apparatus 60. Each of the base plate 62, front plate 64, and rear plate 66 are rectangular. The base plate 62 may be termed a support. Each of the front and rear plates 64, 66 have two top corners 67 that are rounded for safety. The security barrier apparatus 60 is manufactured from steel plate that has a thickness, for example, of 15 mm. It is envisaged that the front and rear plates 64, 66 may be either welded to the base plate 62, or they may be formed by bending the base plate 62 upwards with the application of heat. In either example the security barrier apparatus 60 is made of one rectangular sheet of steel.

It will be appreciated the front plate 64 is a surface that may be used to display an image 68 or other information thereon. The image may be recessed within the front plate 64, for example, using additional steel plate, or may be cut through the front plate 64. The image may be a design feature, or may include a safety feature such as a reflective surface.

Figure 7:
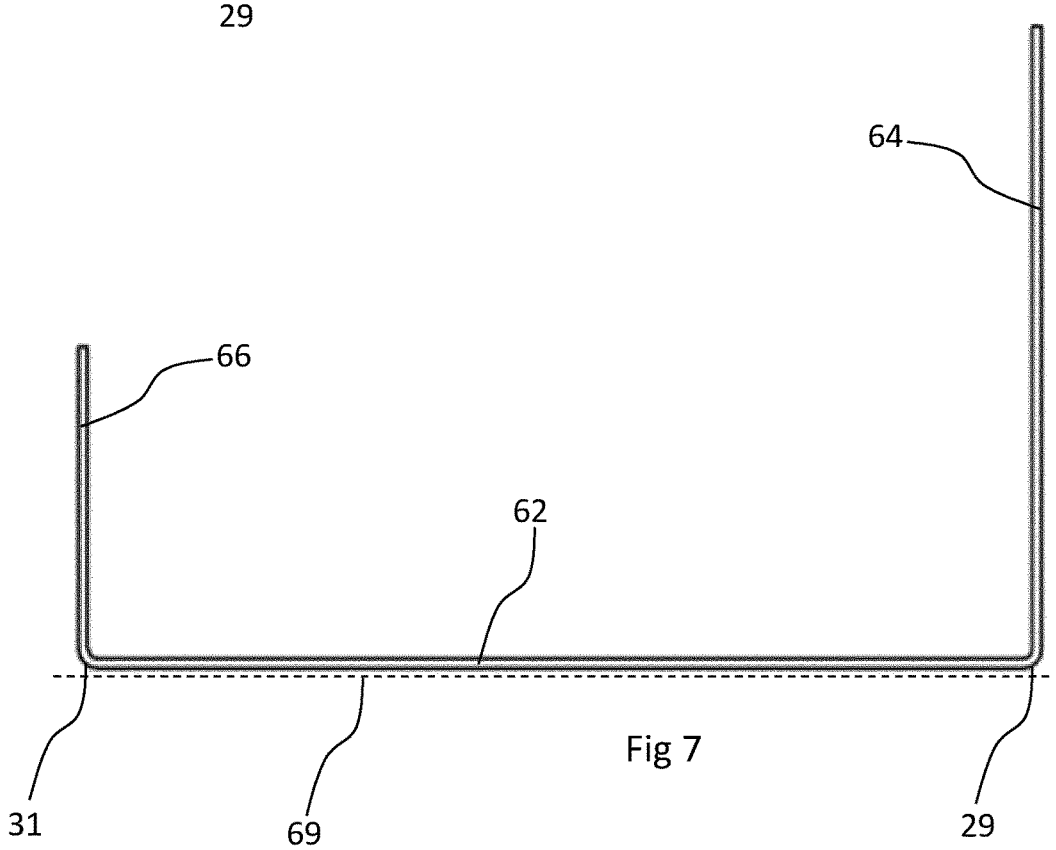
FIG. 7 is a side view of the security barrier shown in FIG. 6.

FIG. 7 is a side view of the security barrier shown in FIG. 6. In FIG. 7 like features to the arrangements of FIG. 7 are shown with like reference numerals. In FIG. 7 the base plate 62 of the security barrier apparatus 60 is shown to be located on a ground surface 69, and each of the front and rear plates 64, 66 are upright relative to the base plate 62. In other words the front and rear plates 64, 66 are substantially vertical relative to the ground surface 69 when the security barrier apparatus 60 is in its normal orientation when in use. The front plate 64 may have a vertical dimension of between 0.5 m to 1.0 m above the base plate 62. The rear plate 62 may have a vertical dimension of about 0.5 m above the base plate 62. The base plate 62 may have a horizontal dimension of about 1.5 m between the front and rear plates 64, 66. It is envisaged that other dimensions for the base plate 62, the front plate 64, and the rear plate 66 may be used as required by a particular application.

Figure 8:
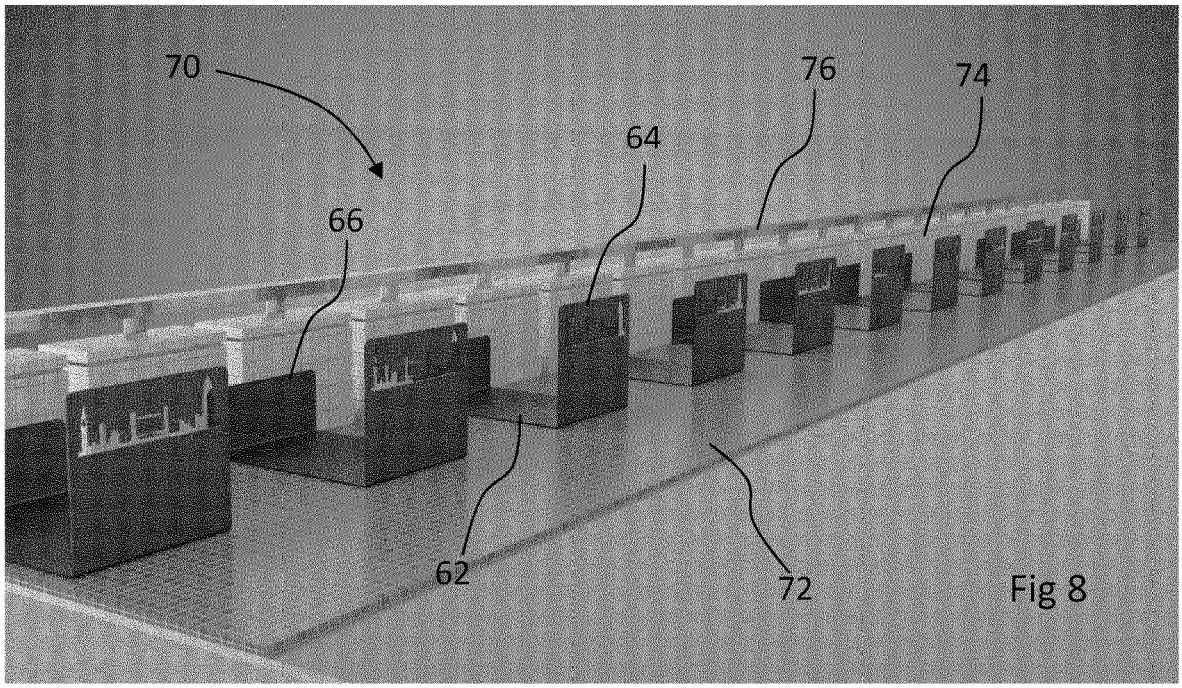
FIGS. 8 and 9 show perspective views of installing the security barrier apparatus of FIGS. 6 and 7 to a bridge structure according to an embodiment of the invention.
Figure 9:
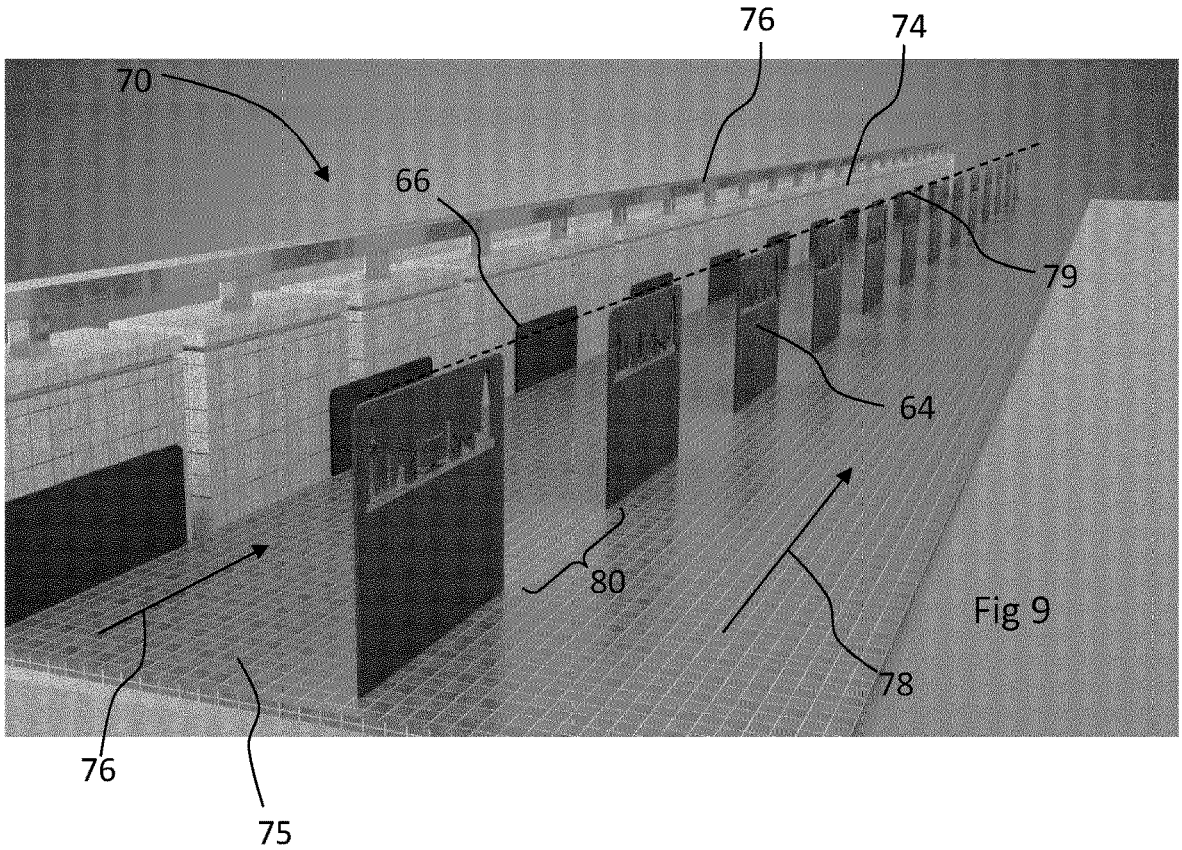

FIGS. 8 and 9 show perspective views of installing the security barrier apparatus 60 of FIGS. 6 and 7 to a bridge structure 70 according to an embodiment of the invention. In FIGS. 8 and 9 like features to the arrangements of FIGS. 6 and 7 are shown with like reference numerals. In FIG. 8 the bridge structure 70 has a deck 72, a retaining wall 74, and a rail 76 according to the typical construction of a bridge structure 70. A plurality of the security barrier apparatuses 60 a placed on the deck 72 so that the base plate 62 of each security barrier apparatus 60 rests thereon. The plurality of the security barrier apparatuses 60 are spaced part from one another and the rear panel 66 of each security barrier apparatus 60 is secured to the retaining wall 74, for example using fasteners (not shown). The fasteners may be expandable bolts arranged to pass through bolt holes (not shown) of the rear panel 66 and into the retaining wall 74. Each rear panel 66 may be termed an attachment portion or an attachment part. In such a manner each security barrier apparatus 60 is provided with at least one wall anchor. It is envisaged that each rear panel 66 has at least one fastener to secure it to the retaining wall 74, and may typically have up to six or more fasteners.

FIG. 9 shows the next stage for installation of the finished security barrier arrangement of FIG. 8. In FIG. 9 the base plate 62 of each of the security barrier 60 is shown to be overlaid with a surface 75 (i.e. covering, slabs, pavers, bricks, tarmac, cement, or other surface such as a walking surface for pedestrians, or other anti-slip coating) such that substantially all of the front panel 64 of each security barrier 60 is above the surface 75, which provides a mass on top of each security barrier 60. The mass on top of each security barrier apparatus 60 anchors them to the deck 72. It will be appreciated that the base plate 62 is about 1.5 cm in height above the deck 72, which is very shallow.

The arrangements shown in FIGS. 8 and 9 provide a pedestrian lane 76 and a vehicle lane 78 such that there are spaces 80 between adjacent front panels 64 of the installed plurality of security barrier apparatuses 60. The spaces 80 allow pedestrians to walk into and out of the pedestrian lane 76 if required.

It can be seen that the front panels 64 of each security apparatus 60 are arranged in a line, or a plane, indicated by dashed line 79, which provide protection for people in the pedestrian lane 76. In the event of an impact by a vehicle on one or more of the front panels 64, the impact load is transferred to the retaining wall 74 due to the rear panel 66 of each security barrier 60.

Figure 10:
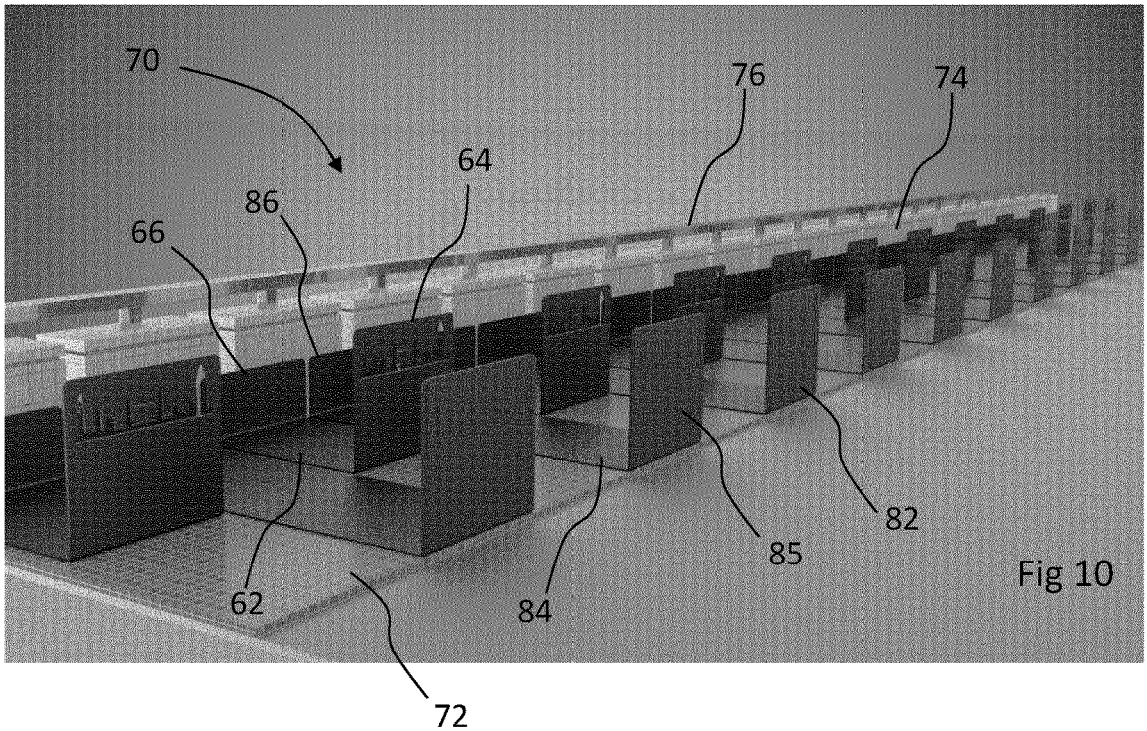
FIGS. 10 and 11 show perspective views of installing the security barrier apparatus of FIGS. 6 and 7 to a bridge structure with a security barrier apparatus according to a embodiment of the invention.
Figure 11:
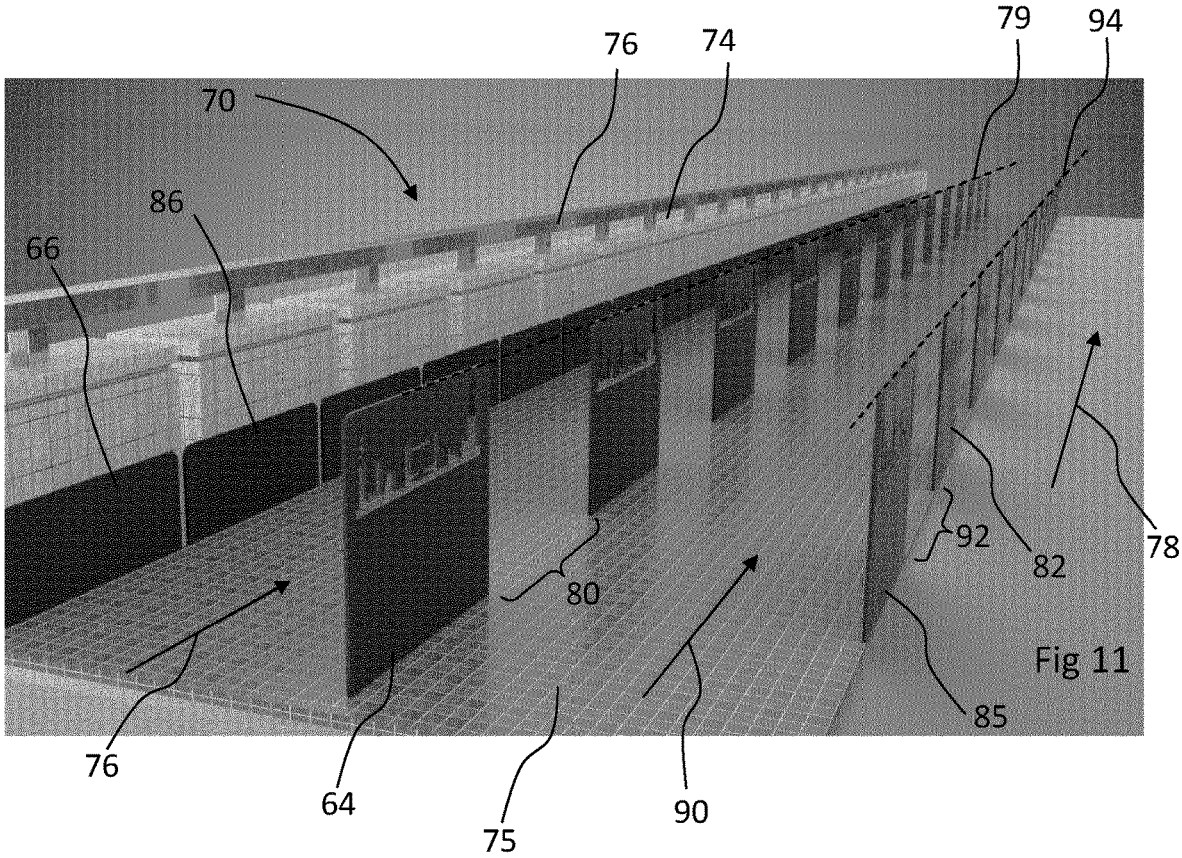

FIGS. 10 and 11 show perspective views of installing the security barrier apparatus 60 of FIGS. 6 and 7 to a bridge structure 70 with a security barrier apparatus 82 according to an embodiment of the invention. In FIGS. 10 and 11 like features to the arrangements of FIGS. 8 and 9 are shown with like reference numerals. The arrangements of FIG. 10 are the same as the arrangements of FIG. 8 apart from a plurality the security barrier apparatuses 82 which are located in the space 80. Each security barrier apparatus 80 has a longer base plate 84 than the base plate 62 of the security barrier apparatus 60. The base plate 84 may be termed a support. Each security barrier apparatus 82 has a front panel 85 and a rear panel 86 in a similar manner to the security barrier apparatus 60. The security barrier apparatuses 82 are placed on the deck 72 so that the base plate 82 of each security barrier apparatus 82 rest thereon. In other words the plurality of the security barrier apparatuses 60 are spaced part from one another so that the space 80 is provided between front panels 64 thereof, and the base plates 84 of each security barrier apparatus 82 are located within the space 80. The rear panel 86 of each security barrier apparatus 82 is secured to the retaining wall 74, for example using fasteners (not shown), which may be expandable bolts arranged to pass through bolt holes (not shown) of the rear panel 86 and into the retaining wall 74. In such a manner each security barrier apparatus 82 is also provided with at least one wall anchor. It is envisaged that each rear panel 86 has at least one fastener to secure it to the retaining wall 74, and may typically have up to six or more fasteners.

FIG. 11 shows the next stage for installation of the finished security barrier arrangement of FIG. 10. In FIG. 11 the base plate 84 of each of the security barrier 82 is shown to be overlaid with the surface 74 (i.e. covering, slabs, pavers, bricks, tarmac, cement, or other surface such as a walking surface for pedestrians, or other anti-slip coating) such that substantially all of the front panels 64 and 85 of each security barrier 60 and 82 is above the surface 74, which provides a mass on top of each security barrier 60 and 82. The mass on top of each security barrier apparatus 60 and 82 anchors them to the deck 72. It will be appreciated that the base plate 84 is about 1.5 cm in height above the deck 72, which is very shallow.

The arrangements shown in FIGS. 10 and 11 provide a pedestrian lane 76, a vehicle lane 78, and a cycle lane 90 such that there are spaces 80 between adjacent front panels 64 of the installed plurality of security barrier apparatuses 60, and spaces 92 between adjacent front panels 85 of the installed plurality of security barrier apparatuses 82. The spaces 80 allow pedestrians to walk into and out of the pedestrian lane 76 if required. The spaces 92 allow cyclists to enter and exit the cycle lane 90, and pedestrians to walk into and out of the cycle lane 90 if required.

It can be seen that the front panels 85 of each security apparatus 82 is arranged in a line, or a plane, indicated by dashed line 94, which provide protection for cyclists in the cycle lane 90. In the event of an impact by a vehicle on one or more of the front panels 64 or 85, the impact load is transferred to the retaining wall 74 due to the rear panel 66 and 86 of each security barrier 60 and 82.

In the embodiments of FIGS. 6 to 11 there are no fasteners used to secure the base plates 62, 84 to the deck 72 of the bridge 70. This is generally required in order not to interfere with the structure of the bridge 70, or services such as electricity lines. However, additional fasteners (e.g. expandable bolts) may be used to secure the base plates 62, 84 to the deck 72 if required. For example, each base plate 62, 84 may have holes spaced thereon to receive fasteners to provide additional anchors points of the security barriers 60, 82 to the deck 72.

Figure 12:
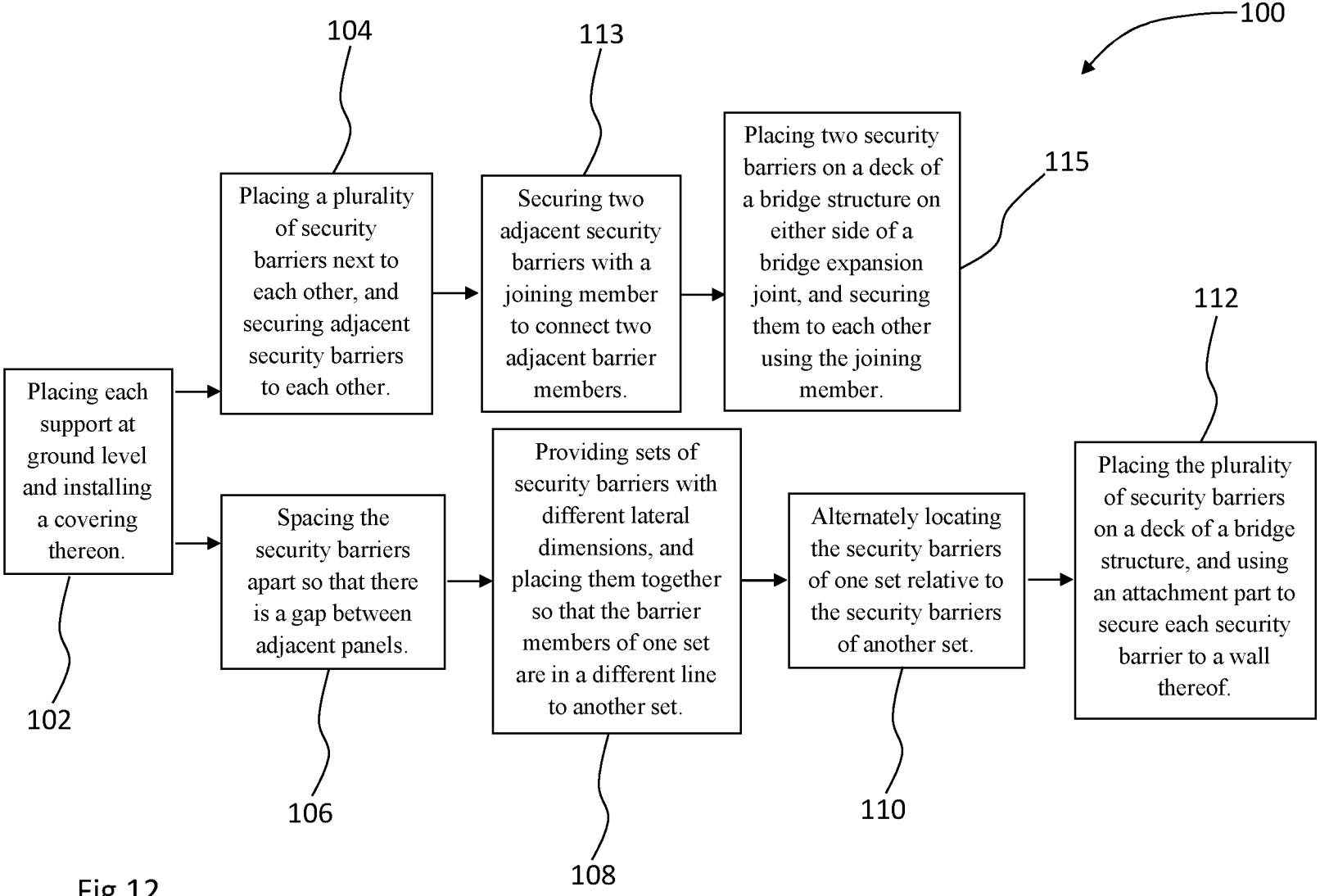
FIG. 12 shows steps of a method for installing a security barrier apparatus according to an embodiment of the invention.

FIG. 12 shows steps of a method for installing one or more security barriers a security barrier apparatus according to an embodiment of the invention, generally designated 100. It will be appreciated that the steps may be performed in a different order, and may not necessarily be performed in the order shown in FIG. 12. In FIG. 12 the method 100 is a method of installing one or more security barriers 10, 40, 60, 82 for inhibiting the passage of a vehicle. Each security barrier 10, 40, 60, 82 comprising a support 12, 62, 84 having at least one upright barrier member 14, 64, 85 thereon. Each support 12, 62, 84 having a portion that is substantially planar and having a leading edge 29. Each barrier member 14, 64, 85 being at the leading edge 29 or adjacent to the leading edge of each support 12, 62, 84. The method 100 including placing each support at ground level 41, 69 and installing a covering onto the portion of each security barrier for adding mass thereto and to bias each security barrier 10, 40, 60, 82 towards the ground level, as shown at 102.

The method 100 further includes placing a plurality of security barriers 10, 40, 60, 82 at ground level wherein adjacent security barriers are next to each other, and securing adjacent security barriers to each other along a lateral edge thereof such that the barrier members 14, 64, 85 of the plurality of security barriers are in line with each other, as shown at 104.

The method 100 further includes using one or more connector parts 42 to secure adjacent security barriers 10, 40, 60, 82, as shown at 104. The method 100 further includes using one or more fasteners to secure adjacent security barriers using the one or more connector parts 42, as shown at 104.

The method 100 further includes placing a plurality of security barriers 10, 40, 60, 82 at ground level 41, 69 wherein the security barriers are spaced apart from one another so that there is a gap 80 between adjacent panels at the leading edges thereof, and so that the barrier members of the plurality of security barriers are in line with each other, as shown at 106.

The method 100 further includes providing first and second sets of security barriers 60, 82 wherein a lateral dimension of the supports 84 of the first set are longer than the supports 62 of a lateral dimension of the second set, and placing the plurality of security barriers 60, 82 at ground level wherein the supports of the plurality of security barriers are next to one another so that the barrier members of the first set are in line with each other, and the barrier members of the second set are in line with each other, as shown at 108.

The method 100 further includes 49 alternately locating the security barriers 60 of the first set relative to the security barriers 82 of the second set, such that a first gap 80 is provided between adjacent panels at the leading edges of the security barriers of the first set 60, and a second gap 92 is provided between adjacent panels at the leading edges of the security barriers of the second set 82, as shown at 110.

Each support has a trailing edge 31 with an attachment part 66, 86, the method further includes placing the plurality of security barriers 60, 82 at ground level on a deck 72 of a bridge structure 70 so that the support 62, 84 of each security barrier rests on the deck 72, and using the attachment part 66, 86 to secure each security barrier 60, 82 to a wall of the bridge structure 70, as shown at 112.

The method 100 further includes placing the plurality of security barriers 10 at ground level, and securing two adjacent security barriers 10 to each other with a joining member 200 to connect two adjacent barrier members 14 of the two adjacent security barriers 10, the joining member 200 for inhibiting the passage of a vehicle in the event of an impact force therefrom, as shown at 113.

The joining member 200 has an expansion joint 204 on at least one end thereof, the method further including securing the two adjacent security barrier members 14 using the expansion joint 204 for permitting the joining member 200 to move relative to the barrier member 14 associated with the expansion joint 204, as shown at 113. The joining member 200 comprises at least one tube 202, 204 at an end thereof, the method further including using the at least one tube 202, 204 to secure the two adjacent security barriers 10 to each other by locating one of the two adjacent barrier members 14 in the tube 202, 204, as shown at 113.

The method further including placing the plurality of security barriers 10 at ground level on a deck 72 of a bridge structure 70 so that the support 12 of each security barrier 10 rests on the deck 72, and so that the two security barriers 10 are at either side of a bridge expansion joint, and securing the two adjacent security barriers 10 to each other using the joining member 200 so that it is above the bridge expansion joint, as shown at 115.

Figure 13:
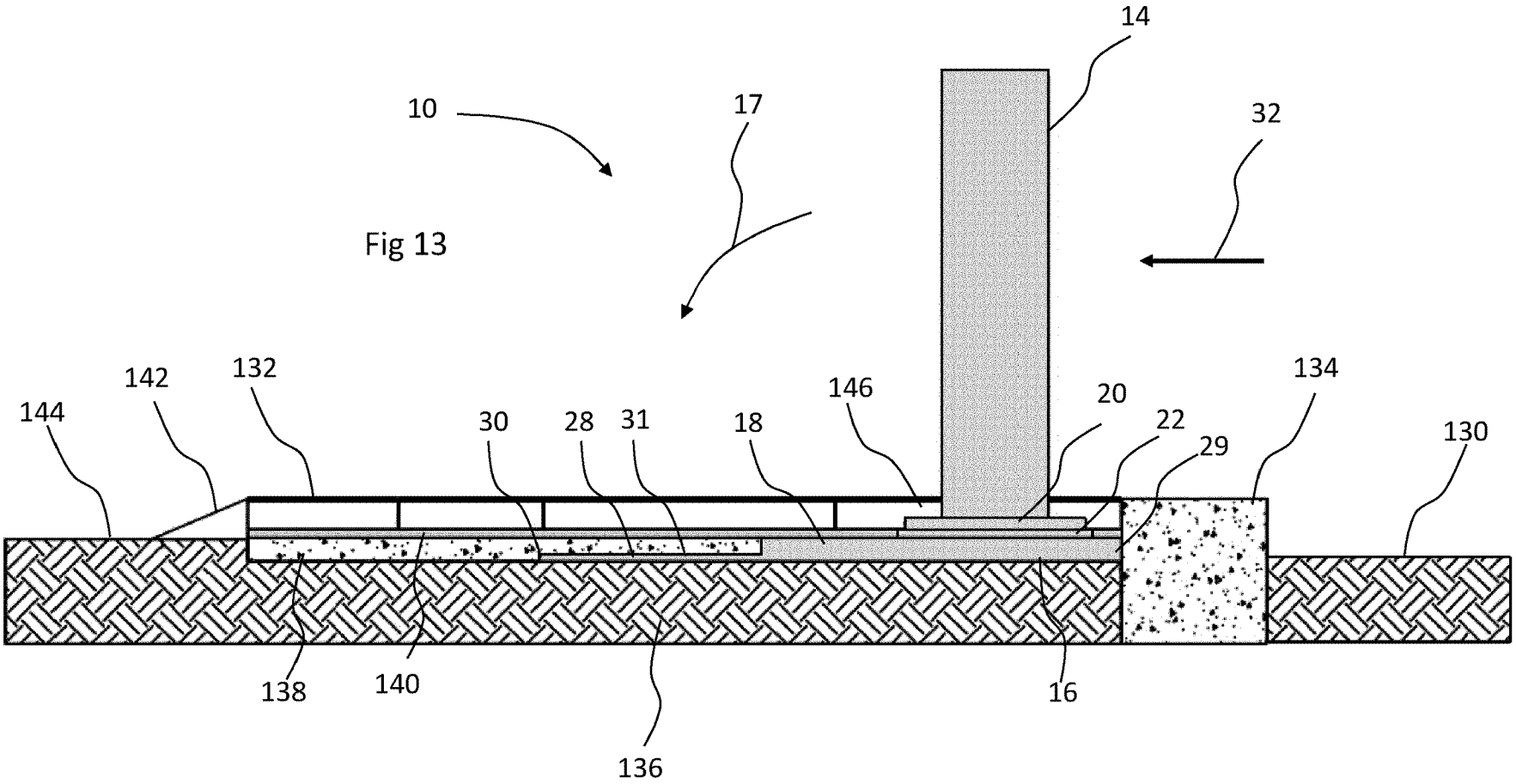
FIG. 13 shows a schematic side view of an installation for the embodiment of FIGS. 1 to 5.

FIG. 13 shows a schematic side view of an installation for the embodiment of FIGS. 1 to 5. In FIG. 13 like features to the arrangements of FIGS. 1 to 5 are shown with like reference numerals. In FIG. 13 a road side 130 (i.e. tarmac) and a pavement side 132 (i.e. slabs) are shown on either side of the security barrier 10. The leading edge 29 abuts a concrete kerb 134 that is located in the ground 136. It is envisaged that a hole in the ground 136 having a depth of 4.5 cm or 5.0 cm would be excavated for the base 12 of the security barrier 10, which is situated in the excavated region so that the leading edge 29 thereof abuts the concrete kerb 134. Concrete 138 would then be poured on top of the extension part 28 of the lower plate 16 so that it covers the teeth 30, 35, and the concrete 138 would also extend for a horizontal distance of about 0.6 m beyond the tips of the teeth 30, 35. A top surface of the concrete 138 is level with the top plate 18. A sand bed 140 would then be spread on top of the concrete 138 when set, and the slabs 132 would be installed on top of the sand bed 140. A ramp 142 (i.e. retaining slope) may be installed between the slabs 132 and a surface 144 that may level with the top plate 18. A concrete surround 146 may also be poured around the post 14 to finish the upper surface and to avoid the need to cut slabs 132 around the post 14. Alternatively slabs 132 may be cut and fitted around the post 14. The slabs 132 may have a thickness of about 6.3 cm.

In one arrangement the security barrier 10 is placed directly onto a tarmac surface (or other driving or walkway surface), and then concrete 138 and slabs 132 are added on top as per the arrangements with reference to FIG. 13.

It will be understood from the foregoing description that the security barriers 60, 82 of FIGS. 6 to 13 provide pedestrian lane 76 or cycle lane 90 protection for a bridge to inhibit a vehicle from intruding into the passenger or cycle lane 76, 90. The base plates 62, 84 of the security barriers 60, 82 are covered by the surface 75, and as such are sufficiently recessed to avoid a trip hazard. Furthermore, the surface 75 on top of the base plate 62, 84 assist with anchoring the security barriers 60, 82 to the bridge 70.

It will be understood from the foregoing description that the security barrier 10, 40, 60, 82 of FIGS. 1 to 13 is self-supporting because it does not require fixings into the ground. In the embodiments shown in FIGS. 6 to 11 the security barrier 60 is secured to a retaining wall 74, which may be a bridge wall, or a wall of a building or other structure, or a railing or the like. In the embodiments of in FIGS. 6 to 11 the security barrier 60 may be retrofit to an existing bridge 70 (i.e. retaining wall 74, bridge wall, or a wall of a building or other structure, or railing), for example in front of a shop or entrance.

It is also envisaged that the security barrier 10, 40, 60, 82 may be placed on a road or driveway in order to safeguard an entrance to the road or driveway. The relatively large footprint of the security barrier apparatus 10, 40, 60, 82 means that a large number of pavers (i.e. covering, slabs, bricks, tarmac, cement blocks, or cement etc) can rest on top thereof, which provides additional mass to the security barrier apparatus 10, 40, 60, 82 to assist with transfer of any impact load to the ground or retaining wall 74.

It will be appreciated the security barrier 10, 40, 60, 82 is a surface mounted device so that it can be mounted on the ground surface 41, 69, 72. The base 12 or base plate 62, 84, is relatively shallow, being for example, 12 cm or 1.5 cm above the ground surface 41, 69, 72 so that it does not interference with services or structures on which it is placed. This means that the base 12 or base plate 62, 84 has a very low height but the security barrier 10, 40, 60, 82 is still a substantial barrier that may withstand or deflect a vehicle to protect pedestrians or cyclists. Furthermore, the arrangement of the base 12 or base plate 62, 84 being below the upper surface means that there is no risk of a person tripping when walking on the security barrier 10, 40, 60, 82.

The security barrier 10, 40, 60, 82 may be arranged to be temporarily located on the ground surface 41, 69, 72 so that it is removable, or it may be permanently fitted to the ground surface 41, 69, 72, for example by cementing. Providing a temporary arrangement means that the security barrier 10, 40, 60, 82 may be considered to be portable. The security barrier 10, 40, 60, 82 may be configured as a high security barrier apparatus for anti-terrorist applications, or a relatively low security barrier apparatus.

Whereas substantially vertical and straight barrier members (i.e. posts 14, front panels 64, 85) are shown in the above embodiments it will be appreciated that alternative shapes and configurations of the posts 14, and front panels 64, 85 may also be used.

In the above embodiments it will be appreciated that the planes 46, 79, 94 correspond to the upright posts 14 or front panels 64, 85 which define the planes. The planes may be a substantially upright planes such that they are normal to the base 12, or base plates 62, 72 or the ground surface 41, 69, 72. Alternatively the planes may be inclined as required.

In one arrangement each security barrier apparatus 60, 82 has one front panel 64, 85 and one rear panel 66, 86. It is also envisaged that there may be more than one front panel 64, 85 or rear panel 66, 86 on the security barrier apparatus 60, 82 as required, for example, two front panels 64, 85 and/or two rear panels 66, 86 for each security barrier apparatus 60, 82.

Figure 14:
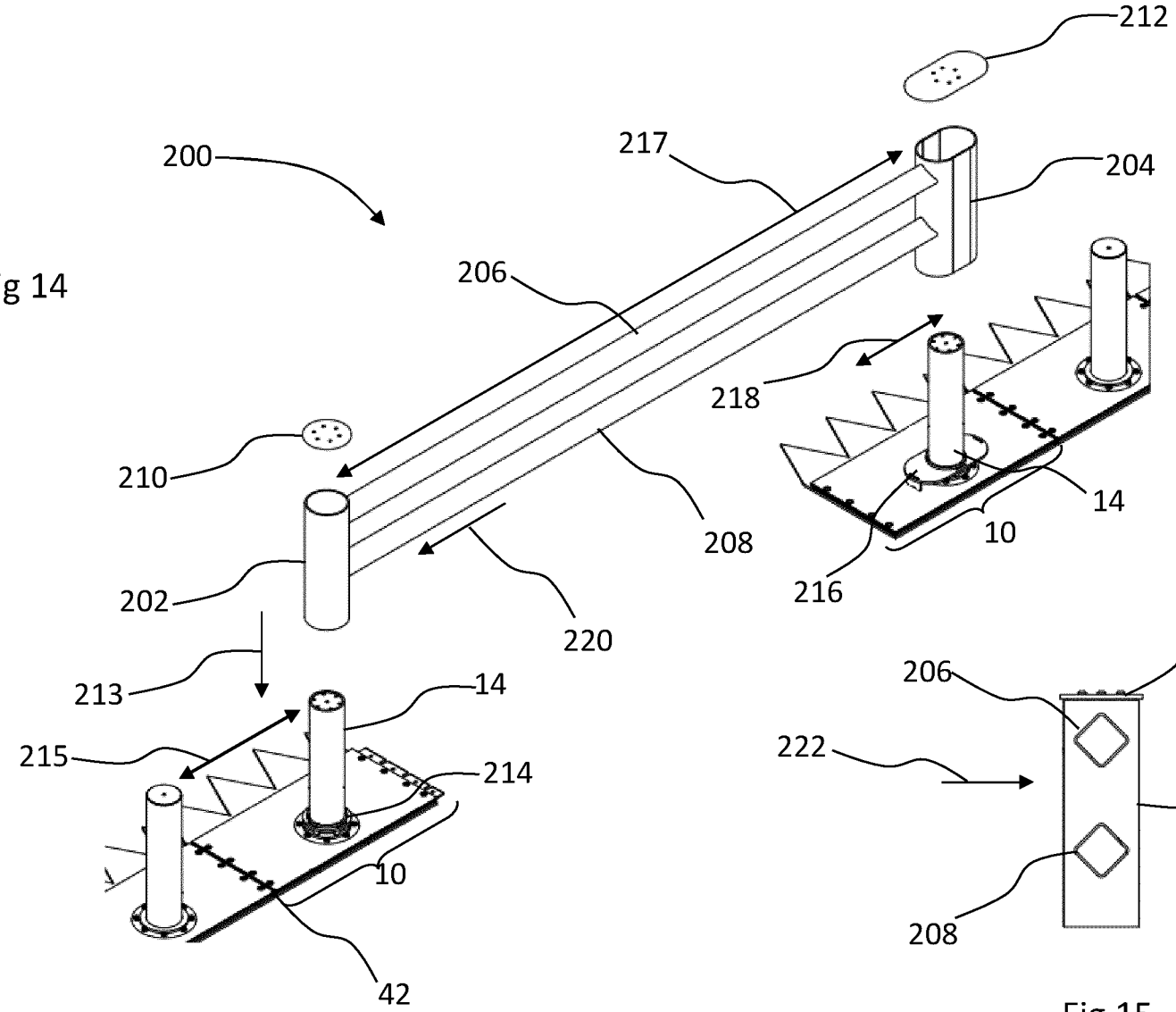
FIG. 14 shows a perspective view of the embodiments of FIGS. 1 to 5 used with an expansion device.

FIG. 14 shows a perspective view of the embodiments of FIGS. 1 to 5 used with an expansion device, generally designated 200. The expansion device 200 may be alternatively termed a joining member. In FIG. 14 like features to the arrangements of FIGS. 1 to 5 are shown with like reference numerals. In FIG. 14 the expansion device 200 has two uprights tubes 202, 204 that are spaced apart from one another and joined together with two beams 206, 208. One beam 206 is vertically above the other beam 208 such that one beam 206 is 40 cm above ground level and the other bean 208 is 80 cm above ground level. It will be appreciated that there may be more or less than two beams 206, 208 which are rigid, and that alternative arrangements are also envisaged that are not rigid such as one or more cables or chains instead of the beams 206, 208. The beams 206, 208 or cables/chains may be termed connection members or joining members. The tubes 202, 204 and the beams 206, 208 are of steel and are welded together. Each tube 202, 204 has a respective cap plate 210, 212, which is about 1.5 cm thick. The expansion device 200 is arranged to fit over two security barriers 10 so that each post 14 thereof is located in a respective tube 202, 204 as indicated by arrow 213. The tubes may be termed connection devices. In this manner the posts 14 of the adjacent barriers 10 are connected or joined together with the expansion device 200 so that the adjacent barriers 10 are spaced apart by the expansion device 200. Each cap plate 210, 212 is then bolted onto a respective post 14 to secure the expansion device 200 to the two security barriers 10. In effect the cap plates 210, 212 fix each tube 202, 204 to a respective barrier member 14 by sandwiching each tube 202, 204 between each cap plate 210, 212 the support 12 of each security barrier 10. It will be appreciated that whereas four security barriers 10 are shown in FIG. 14 there may be many more security barriers 10 connected in a row using connector plates 42 previously described.

One of the tubes 202 has a circular cross-section and rests on a ring 214 at a base of the post 14 before being fixed securely to the post 14 using the cap plate 210. The post 14 may also have a centralising ring at a base thereof which has a smaller diameter than an inner diameter of the tube 202 to centre it relative to the post 14. One of the tubes 204 has an elongate cross-section and rests on a slide plate 216 at a base of the post 14 so that it is free to move in a horizontal direction (i.e. a lateral direction or a translatable direction) relative to the post 14 over which it is located in the direction shown by arrow 218. It will be appreciated that the tube 202 is not free to move relative to its respective post 14, whereas the tube 204 is free to move in a horizontal direction 218 relative to its respective post 14. The tube 204 is retained to its respective post 14 using the cap plate 212 so that a slidable joint (i.e. an expansion joint) is created. Such a slidable joint requires a gap between the top of the tube 204 and an underside of the cap plate 212.

It will be understood that the elongate cross-section of the tube 204 comprises a geometric shape constructed of a rectangle with semicircles at a pair of opposite sides thereof. Such an elongate cross-section of the tube 204 may also be known also as a discorectangle, an obround, or a sausage body. The elongate cross-section of the tube 204 permits horizontal (i.e. lateral) movement of the post 14 relative to the tube 204 of 75 mm in either direction from a centre line. In other words the post 14 within the tube 204 can move in a lateral direction, for example up to 150 mm in total.

Figure 15:
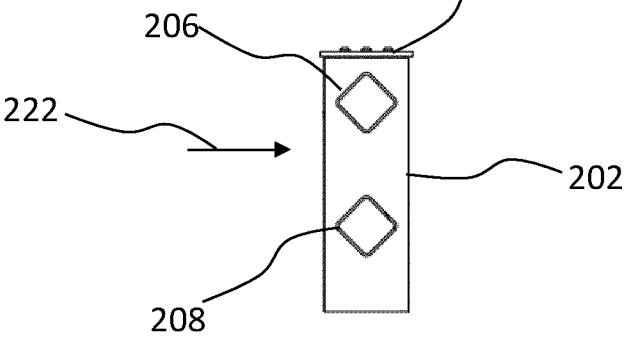
FIG. 15 is a side view of a tube shown in FIG. 14.

FIG. 15 is a side view of a tube 202 shown in FIG. 14 viewed from the direction shown by arrow 220. In FIG. 15 like features to the arrangements of FIG. 14 are shown with like reference numerals. In FIG. 15 the beams 206, 208 are shown to have a square cross-section so that opposing edges of the square cross-section are arranged horizontally and vertically respectively. Such an arrangement assists with the deflection of an impact by a vehicle indicated by arrow 222 whereby the vehicle may be deflected upwards or downwards. Furthermore, arranging the square cross-section beams 206, 208 in this manner means that they are more resistant to bending due to an impact 222 than would otherwise be the case if the beams 206, 208 were arranged with their opposing surfaces being horizontally and vertically respectively.

Figure 16:
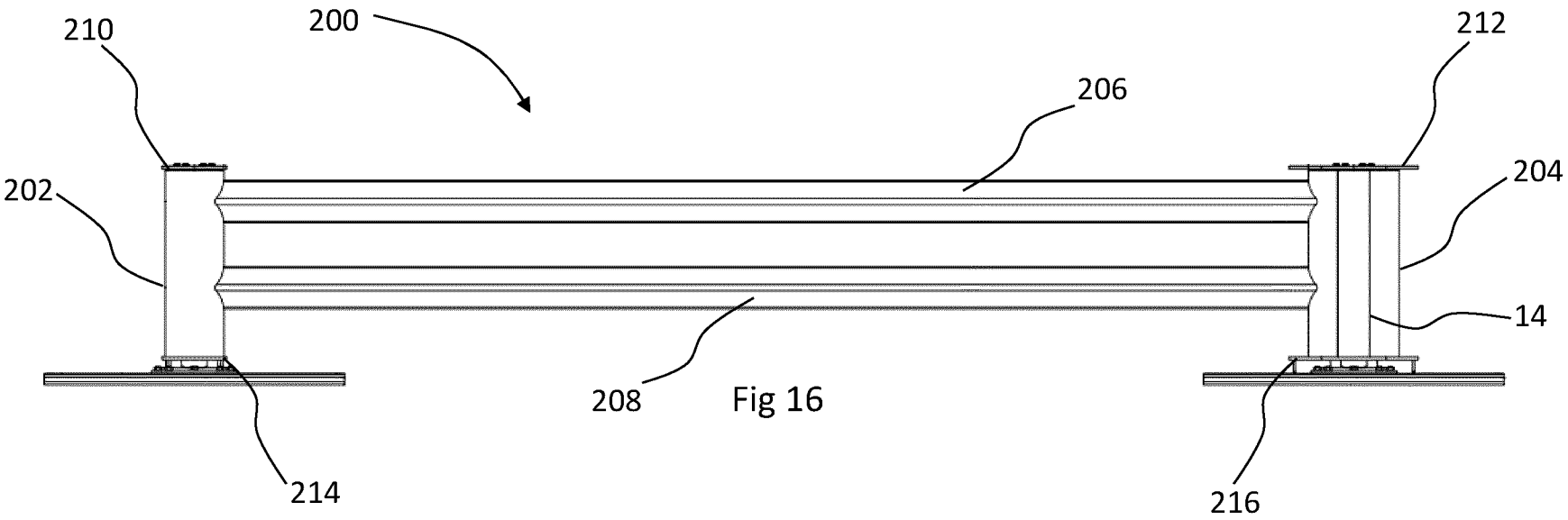
FIG. 16 is a front view of the expansion device of FIG. 14.
Figure 17:
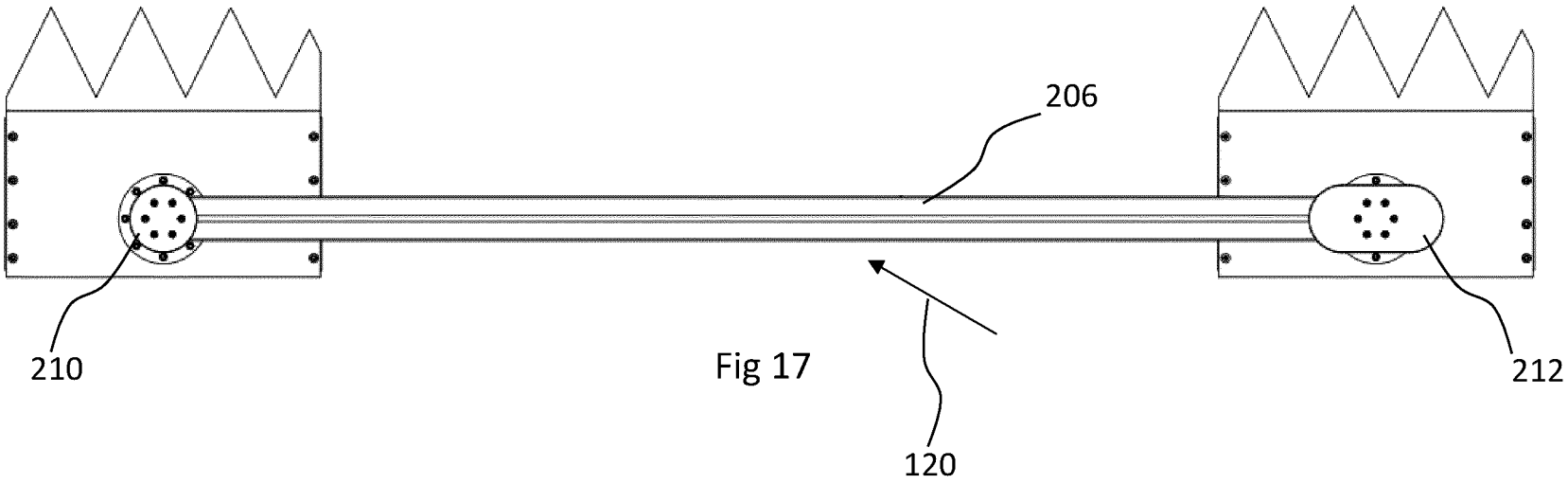
FIG. 17 is a plan view of the arrangement of FIG. 16.

FIG. 16 is a front view of the expansion device 200 of FIG. 14. FIG. 17 is a plan view of the arrangement of FIG. 16. In FIGS. 16 and 17 like features to the arrangements of FIG. 14 are shown with like reference numerals. In FIG. 16 the post 14 is illustratively shown within the upright tube 204 within it.

The arrangement of FIGS. 14 to 17 provide the advantage that the security barriers 10 can be fitted to a bridge having an expansion joint. Such a bridge typically requires an expansion joint between sections of the bridge to allow the bridge to move slightly, for example as may be required due to heat expansion, or movement of the bridge due to traffic or earth tremors. The expansion device 200 may also provide additional protection for pedestrians or cyclists, and can be used to tie together two rows of the security barriers 10 as shown in FIG. 14. Furthermore, the expansion device 200 may also be used to bridge manhole covers or other access covers for services in the ground. Whereas a gap 215 (shown in FIG. 14) between posts 14 of adjacent security barriers 10 that are secured by a connector plate 42 may be 1.4 m, it will be understood that a gap 217 (shown in FIG. 14) between the tubes 202, 204 may be larger, for example 5.1 m.

Using the expansion device 200 and/or the connector plates 42 to attach security barriers 10 together further assists with transferring an impact force (i.e. as shown by arrows 32, 120 in FIGS. 1, 5, and 17) from one security barrier 10 to another security barrier 10, and from each security barrier 10 to the ground. It is also envisaged that the expansion device 200 of FIGS. 14 to 17 may be used with the security barriers shown in the embodiments of FIGS. 6 to 11.

It will be understood that the security barriers 10, 40, 60, 70, 200 described above are not bolted to the ground or fastened to the ground in any way using fasteners or bolts, and are instead biased towards to the ground under the action of gravity on the mass of the covering which is on each security barrier 10, 40, 60, 70, 200.

What is claimed is:

1. A security barrier apparatus comprising:

a plurality of security barriers, wherein each security barrier of the plurality of security barriers includes a support having at least one upright barrier member thereon, the support for positioning substantially at ground level, the support having a portion that is substantially planar and having a leading edge, the at least one barrier member being at the leading edge or adjacent to the leading edge, the portion for receiving a covering thereon for adding mass to a respective security barrier of the plurality of security barriers and for biasing the respective security barrier towards the ground level, the barrier member for inhibiting a passage of a vehicle in the event of an impact force therefrom being exerted on the at least one barrier member, wherein two adjacent security barriers of the plurality of security barriers are joined to each other with a joining member to connect two adjacent barrier members of the two adjacent security barriers, the joining member for inhibiting the passage of the vehicle in the event of the impact force therefrom, wherein the joining member has a connection device at each end thereof for securing each end of the joining member to the two adjacent barrier members, wherein at least one of the connection devices comprises an expansion joint for permitting the joining member to move relative to the barrier member associated with the expansion joint.

2. A security barrier apparatus according to claim 1, wherein the at least one barrier member comprises at least one post or panel, wherein the at least one post or panel is at the leading edge of the respective security barrier.

3. A security barrier apparatus according to claim 1, wherein the portion has a trailing edge comprising one or more teeth, each tooth extending in substantially a horizontal direction.

4. A security barrier apparatus according to claim 3, further comprising a plurality of teeth, wherein at least one of the teeth has a different horizontal dimension to another of the teeth.

5. A security barrier apparatus according to claim 1, wherein the support has one or more attachment locations along a lateral edge thereof.

6. A security barrier apparatus according to claim 5, further comprising a connector part for cooperation with the one or more attachment-locations.

7. A security barrier apparatus according to claim 1, wherein the support has a depth in the vertical dimension of between 0.01 m and 0.24 m.

8. A security barrier apparatus according to claim 1, wherein the support has one or more attachment locations along a lateral edge thereof, wherein the plurality of security barriers are secured to each other along the lateral edge thereof such that the barrier members of the plurality of security barriers are in line with each other.

9. A security barrier apparatus according to claim 8, wherein one or more connector parts are provided between adjacent security barriers of the plurality of security barriers.

10. A security barrier apparatus according to claim 2, wherein the plurality of security barriers are spaced apart from one another so that there is a gap between adjacent posts or panels at the leading edges thereof, and so that the barrier members of the plurality of security barriers are in line with each other.

11. A security barrier apparatus according to claim 1, wherein at least one of the connection devices comprises a tube, and wherein one of the two adjacent barrier members is located in the tube.

12. A security barrier apparatus according to claim 11, wherein the tube has an elongate cross-section and comprises the expansion joint.

13. A security barrier apparatus according to claim 1, wherein the joining member comprises at least one beam.

14. A method of installing a plurality of security barriers for inhibiting a passage of a vehicle, each security barrier of the plurality of security barriers comprising a support having at least one upright barrier member thereon, each support having a portion that is substantially planar and having a leading edge, each barrier member being at the leading edge or adjacent to the leading edge of each support, the method comprising:

placing each support of the plurality of security barriers at ground level;

installing a covering onto the portion of each security barrier of the plurality of security barriers for adding mass thereto and to bias each security barrier of the plurality of security barriers towards the ground level;

securing two adjacent security barriers of the plurality of security barriers to each other with a joining member to connect two adjacent barrier members of the two adjacent security barriers, the joining member for inhibiting the passage of the vehicle in the event of an impact force therefrom, wherein the joining member has an expansion joint on at least one end thereof; and securing the two adjacent security barrier members using the expansion joint for permitting the joining member to move relative to the barrier member associated with the expansion joint.

15. A method according to claim 14, wherein adjacent security barriers of the plurality of security barriers are next to each other, the method further comprising securing the adjacent security barriers to each other along a lateral edge thereof such that the barrier members of the plurality of security barriers are in line with each other.

16. A method according to claim 15, further comprising using one or more connector parts to secure the adjacent security barriers.

17. A method according to claim 14, further comprising:

placing the plurality of security barriers at ground level wherein the plurality of security barriers are spaced apart from one another so that there is a gap between adjacent barrier members at the leading edges thereof, and so that the barrier members of the plurality of security barriers are in line with each other.

* * * * *